US009983522B2

(12) United States Patent
Imaizumi et al.

(10) Patent No.: US 9,983,522 B2
(45) Date of Patent: May 29, 2018

(54) FIXING DEVICE

(71) Applicant: CANON KABUSHIKI KAISHA, Tokyo (JP)

(72) Inventors: Toru Imaizumi, Kawasaki (JP); Takashi Narahara, Mishima (JP); Atsutoshi Ando, Yokohama (JP); Yasuhito Minamishima, Yokohama (JP); Tomoya Tateishi, Kamakura (JP); Masafumi Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/294,942

(22) Filed: Oct. 17, 2016

(65) Prior Publication Data

US 2017/0031283 A1 Feb. 2, 2017

Related U.S. Application Data

(62) Division of application No. 14/955,334, filed on Dec. 1, 2015, now Pat. No. 9,507,303, which is a division (Continued)

(30) Foreign Application Priority Data

Dec. 28, 2012 (JP) ..... 2012-288234
Jun. 10, 2013 (JP) ..... 2013-122215

(51) Int. Cl.
*G03G 15/20* (2006.01)

(52) U.S. Cl.
CPC ..... *G03G 15/2053* (2013.01); *G03G 15/2017* (2013.01); *G03G 15/2057* (2013.01); *G03G 15/2064* (2013.01); *G03G 15/2089* (2013.01)

(58) Field of Classification Search
CPC ..... G03G 15/2053; G03G 15/2017; G03G 15/2057; G03G 15/2064; G03G 15/2089; G03G 15/2035
See application file for complete search history.

(56) References Cited

U.S. PATENT DOCUMENTS 5,404,214 A 4/1995 Yoshimoto et al.
6,794,611 B2 9/2004 Kataoka et al.
(Continued)

FOREIGN PATENT DOCUMENTS

CN 1402093 A 3/2003
CN 1499312 A 5/2004
(Continued)

OTHER PUBLICATIONS

Chinese Office Action dated Jul. 24, 2015, in counterpart Chinese Patent Application No. 201310740345.6 and English translation thereof.
(Continued)

*Primary Examiner* — Rodney Bonnette
(74) *Attorney, Agent, or Firm* — Fitzpatrick, Cella, Harper & Scinto

(57) ABSTRACT

A fixing device includes a cylindrical film, a planar heater, a heat conduction member, a supporting member, a limiting member for limiting heater end portions with respect to a generatrix direction of the film so as to prevent the end portions from moving in a heater thickness direction relative to the supporting member, and a pressing member. A fixing device state is switchable between a first state in which a press-contact force in the nip is enough to fix the toner image and a second state in which the press-contact force in the nip is smaller than the press-contact force in the first state. A surface where the supporting member opposes the heat conduction member has a shape such that with respect to the generatrix direction, a central portion of the film is projected toward the pressing member to a greater extent than an end portion of the film.

8 Claims, 18 Drawing Sheets

Related U.S. Application Data of application No. 14/141,687, filed on Dec. 27, 2013, now Pat. No. 9,229,388.

(56) References Cited

U.S. PATENT DOCUMENTS

| | | | |
|---|---|---|---|
| 7,003,253 | B2 | 2/2006 | Uchida et al. |
| 7,177,579 | B2 | 2/2007 | Uchida et al. |
| 7,209,696 | B2 | 4/2007 | Umezawa et al. |
| 7,283,145 | B2 | 10/2007 | Kato et al. |
| 7,366,455 | B2 | 4/2008 | Iwasaki et al. |
| 7,389,079 | B2 | 6/2008 | Narahara et al. |
| 7,424,260 | B2 | 9/2008 | Nishiyama et al. |
| 7,428,390 | B2 | 9/2008 | Ando |
| 7,469,120 | B2 | 12/2008 | Iwasaki et al. |
| 7,512,370 | B2 | 3/2009 | Shimizu et al. |
| 7,570,895 | B2 | 8/2009 | Ando et al. |
| 7,778,584 | B2 | 8/2010 | Nishiyama et al. |
| 7,792,448 | B2 | 9/2010 | Ando et al. |
| 8,331,819 | B2 | 12/2012 | Fukuzawa et al. |
| 8,670,702 | B2 | 3/2014 | Ikegami et al. |
| 8,712,268 | B2 | 4/2014 | Iwasaki |
| 2003/0038125 | A1 | 2/2003 | Kataoka et al. |
| 2004/0081491 | A1 | 4/2004 | Uchida et al. |
| 2005/0123329 | A1 | 6/2005 | Uchida et al. |
| 2006/0153605 | A1 | 7/2006 | Nishiyama et al. |
| 2008/0292376 | A1 | 11/2008 | Nishiyama et al. |
| 2012/0063823 | A1 | 3/2012 | Ando et al. |
| 2012/0121284 | A1 | 5/2012 | Iwasaki |
| 2013/0028622 | A1 | 1/2013 | Nihonyanagi et al. |
| 2013/0209130 | A1 | 8/2013 | Fukuzawa et al. |
| 2013/0272762 | A1 | 10/2013 | Uekawa et al. |
| 2014/0138372 | A1 | 5/2014 | Ogura |

FOREIGN PATENT DOCUMENTS

| | | | |
|---|---|---|---|
| CN | 1779578 | A | 5/2006 |
| CN | 102467049 | A | 5/2012 |
| GB | 2 339 520 | A | 1/2000 |
| JP | 06-202509 | A | 7/1994 |
| JP | 7-191561 | A | 7/1995 |
| JP | 08-6409 | A | 1/1996 |
| JP | 11-084919 | A | 3/1999 |
| JP | 2003-257592 | A | 9/2003 |
| JP | 2003-317898 | A | 11/2003 |
| JP | 2004-47177 | A | 2/2004 |
| JP | 2004-062053 | A | 2/2004 |
| JP | 2005-114959 | A | 4/2005 |
| JP | 2005-181989 | A | 7/2005 |
| JP | 2009-93017 | A | 4/2009 |
| JP | 2009-224209 | A | 10/2009 |
| JP | 2011-033671 | A | 2/2011 |
| JP | 2011-170102 | A | 9/2011 |
| JP | 2012-194590 | A | 10/2012 |

OTHER PUBLICATIONS

Great Britain Office Action dated Jun. 20, 2014, in counterpart UK Application No. GB1322501.6.

Korean Office Action dated Feb. 19, 2016, issued in counterpart Korean patent application No. 10-2013-0165051.

Office Action dated Apr. 8, 2016, issued in counterpart British patent application No. 1517734.8.

Korean Office Action dated Sep. 1, 2016, issued in counterpart Korean patent application No. 10-2013-0165051.

Office Action dated Aug. 8, 2017 in Japanese Patent Application No. 2016-184725.

(a)

(b)

(a)

(b)

(a)

(b)

(a)

(b)

(a)

(b)

FIXING DEVICE

FIELD OF THE INVENTION AND RELATED ART

The present invention relates to a fixing device for use with an image forming apparatus, such as a copying machine or a printer, of an electrophotographic type.

In recent years, as a type of the fixing device provided in the image forming apparatus of the electrophotographic type, a film fixing type has been used. The fixing device of the film fixing type generally has a constitution including a cylindrical film, a heater contacting an inner surface of the film, a supporting member for supporting the heater at an opposing surface to a surface where the heater contacts the inner surface of the film, and a pressing member for forming a nip, together with the heater, between the pressing member and the film. Further, the fixing device heats a recording material on which a toner image is carried while feeding the recording material through the nip, thus fixing the toner image on the recording material.

As the heater, a heater prepared by forming a heat generating resistor on a substrate of a ceramic material such as alumina or aluminum nitride is used in general. With respect to the heater, one surface contacts the inner surface of the heater, and an opposing surface (the other surface) to the one surface contacting the film contacts the supporting member. A thermosensitive device, such as a thermistor or a fuse, contacts the opposing surface where the heater contacts the supporting member while being supported by the supporting member. The heater controls the amount of electric power supplied thereto by using wave-number control or phase control so that the detection temperature of the thermistor reaches a target temperature. When the heater causes an abnormal temperature rise, the electric power supply to the heater is blocked by the fuse or a thermostat.

Here, as one of problems in the above-described fixing device, there is heater breaking (cracking) due to thermal runaway. The heater breaking due to thermal runaway refers to a phenomenon such that a triac or the like used for controlling the heater is out of order to disable the control of the heater, and thus the electric power is continuously supplied to the heater to break the heater. The cause of this heater breaking includes thermal stress resulting from generation of a difference in temperature of the heater and the generation of mechanical stress, exerted on the heater, by partial melting of the supporting member.

Particularly, heater breaking due to the thermal stress is generated in some cases from a contact with a thermistor or the like, as a starting point, where the temperature difference becomes large between the contact portion and a non-contact portion with the thermistor or the like to generate large thermal stress.

As a countermeasure against heater breaking, interruption of the electric power supply to the heater is performed, before the substrate is broken due to the thermal stress by overheating of the heater, by using a safety device such as the above-described fuse or the like.

However, in recent years, the demand for shortening of FPOT (first page out time) and improvement in productivity has intensified, and in the future, it has been considered that there will be a need to supply large electric power to the heater, and therefore heater breaking can occur in an early stage.

Therefore, Japanese Laid-Open Patent Application (JP-A) Hei 11-84919 discloses a heating device, as shown in FIG. 12, in which a metal plate 14*a* is provided between a heater 12 and a heat-insulating supporting member 11. The metal plate 14*a* as a heat conduction member is interposed between the heat-insulating supporting member 11 and the heater 12, so that localization of a temperature rise can be obviated.

Accordingly, assuming that the safety device is provided on the metal plate 14*a* at an opposing surface to a contact surface with the heater 12, it would be considered that the temperature difference between the contact portion with the safety device and a non-contact portion with the safety device becomes small to decrease the thermal stress and thus heater breaking is not readily generated.

However, in the constitution disclosed in JP-A Hei 11-84919, although the metal plate 14*a* is fixed to the heat-insulating supporting member 11 by an adhesive, the heater 12 and the metal plate 14*a* are merely contacted to each other by a press-contact force in the nip of the heating device.

Accordingly, in the heating device including a pressure-releasing (eliminating) mechanism for eliminating a press-contact state or alleviating the press-contact force during a non-operating period of the heating device, when the press-contact state in the nip is eliminated or when the press-contact force in the nip is alleviated, there is a possibility that a status in which the heater 12 and the metal plate 14*a* are not sufficiently contacted to each other is created. That is, in the case where the press-contact force in the nip is sufficient, the plate 14*a* and the heater 12 are sufficiently contacted to each other by the press-contact force in the nip. However, in the case where the press-contact state in the nip is eliminated or in the case where the press-contact force in the nip is alleviated, by the influence of thickness tolerance, warpage and the like, of the metal plate 14*a*, a status in which the heater 12 and the metal plate 14*a* are not sufficiently contacted to each other can occur.

In the case where thermal runaway causing a disabling of the control of the heater is generated in the status in which the heater 12 and the metal plate 14*a* are not sufficiently contacted, an effect of uniformizing the temperature distribution of the heater 12 by the metal plate 14*a* is not sufficiently achieved, and thus there is a possibility of the generation of heater breaking.

SUMMARY OF THE INVENTION

A principal object of the present invention is to provide a fixing device capable of stably bringing a heater and a metal plate into contact with each other even in the case where in a nip of the fixing device, a press-contact state is eliminated or a press-contact force is alleviated.

According to a first aspect of the present invention, there is provided a fixing device for fixing a toner image on a recording material by heating the toner image while feeding, through a nip, the recording material on which the toner image is carried. The fixing device comprises: a cylindrical film; a planar heater contacting an inner surface of the film; a heat conduction member contacting a surface, of the heater, opposite from a surface where the heater contacts the inner surface of the film; a supporting member for supporting the heater via the heat conduction member; a limiting member for limiting end portions of the heater with respect to a generatrix direction of the film so as to prevent the end portions from moving in a thickness direction of the heater relative to the supporting member; and a pressing member for forming the nip, together with the heater, between the pressing member and the film. A state of the fixing device is switchable between a first state in which a press-contact force in the nip is enough to fix the toner image and a second state in which the press-contact force in the nip is smaller than the press-contact force in the first state. A surface where the supporting member opposes the heat conduction member has a shape such that a central portion of the film with respect to the generatrix direction of the film is projected toward the pressing member more than an end portion of the film with respect to the generatrix direction.

According to a second aspect of the present invention, there is provided a fixing device for fixing a toner image on a recording material by heating the toner image while feeding, in a nip, the recording material on which the toner image is carried. The fixing device comprises: a cylindrical film; a planar heater contacting an inner surface of the film; a heat conduction member contacting a surface, of the heater, opposite from a surface where the heater contacts the inner surface of the film; a supporting member for supporting the heater via the heat conduction member; and a back-up member for forming the nip, together with the heater, between the back-up member and the film. The heat conduction member includes a locking portion at an end portion thereof with respect to a feeding direction of the recording material. The heat conduction member is locked to the supporting member by the locking portion with respect to a direction perpendicular to the feeding direction of the recording material.

According to a third aspect of the present invention, there is provided a fixing device for fixing a toner image on a recording material by heating the toner image while feeding, through a nip, the recording material on which the toner image is carried. The fixing device comprises: a cylindrical film; a planar heater contacting an inner surface of the film; a heat conduction member contacting a surface, of the heater, opposite from a surface where the heater contacts the inner surface of the film; a supporting member for supporting the heater via the heat conduction member; and a back-up member for forming the nip, together with the heater, between the back-up member and the film, wherein the heat conduction member includes a first locking portion provided at a central portion with respect to a direction perpendicular to a feeding direction of the recording material, and a second locking portion and a third locking portion which are provided at end portions so as to sandwich the first locking portion with respect to the direction perpendicular to the feeding direction of the recording material. The heat conduction member is locked to the supporting member by the first locking portion with respect to the direction perpendicular to the feeding direction of the recording material and is locked to the supporting member by the second and third locking portions with respect to the feeding direction of the recording material.

According to a fourth aspect of the present invention, there is provided a fixing device for fixing a toner image on a recording material by heating the toner image while feeding, through a nip, the recording material on which the toner image is carried. The fixing device comprises: a cylindrical film; a planar heater contacting an inner surface of the film; a heat conduction member contacting a surface, of the heater, opposite from a surface where the heater contacts the inner surface of the film; a supporting member for supporting the heater via the heat conduction member; and a back-up member for forming the nip, together with the heater, between the back-up member and the film. The heat conduction member includes a bent portion formed by bending a part of the heat conduction member in a direction crossing the direction perpendicular to a feeding direction of the recording material, and wherein the heat conduction member is locked to the supporting member by the bent portion with respect to the direction perpendicular to the recording material.

These and other objects, features and advantages of the present invention will become more apparent upon a consideration of the following description of the preferred embodiments of the present invention taken in conjunction with the accompanying drawings.

Figure 2:
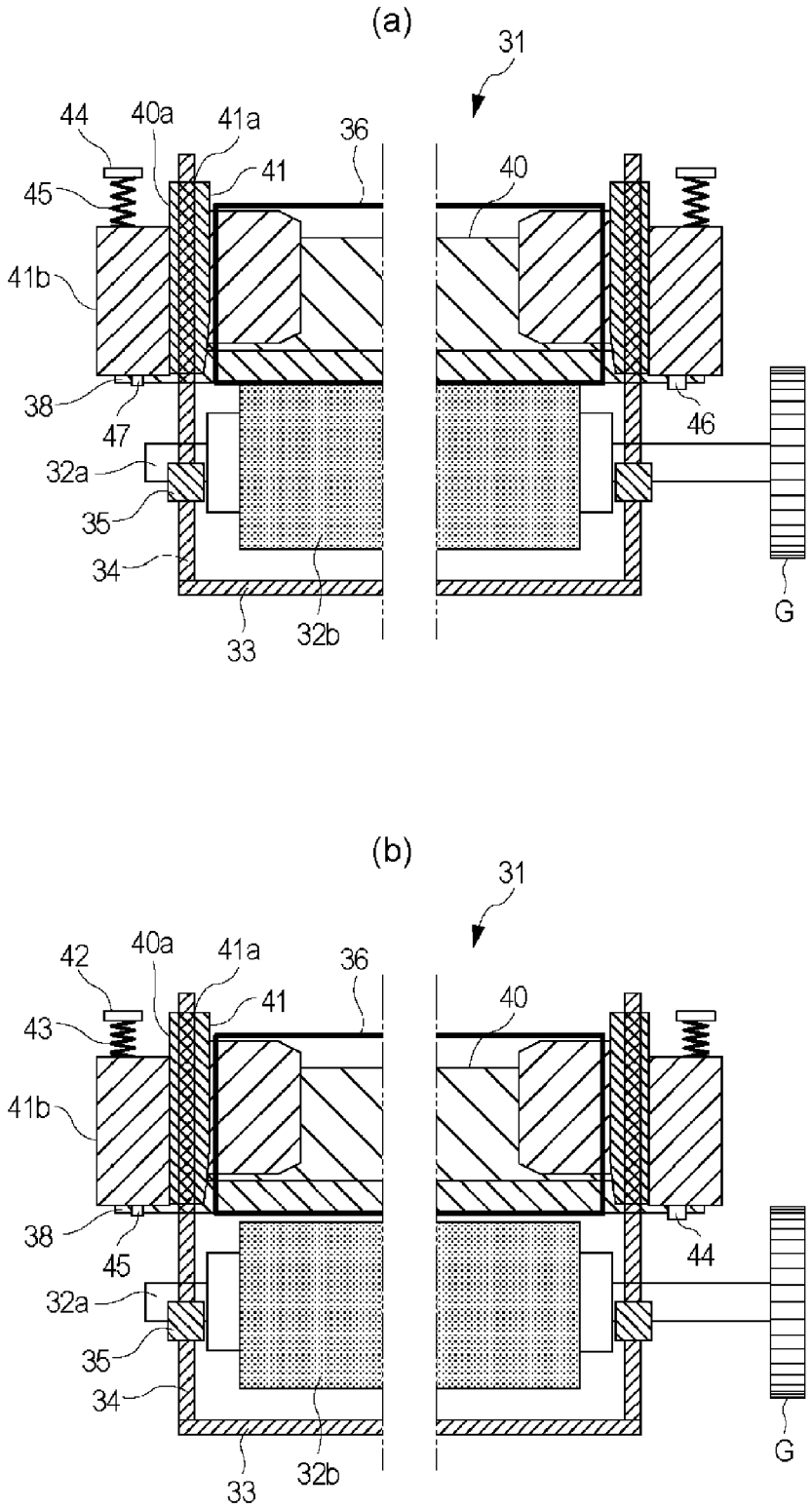

Parts (a) and (b) of FIG. 2 are illustrations of the structure of the fixing device in Embodiment 1, in which (a) shows the fixing device during pressure application and (b) shows the fixing device during pressure elimination.

Figure 3:
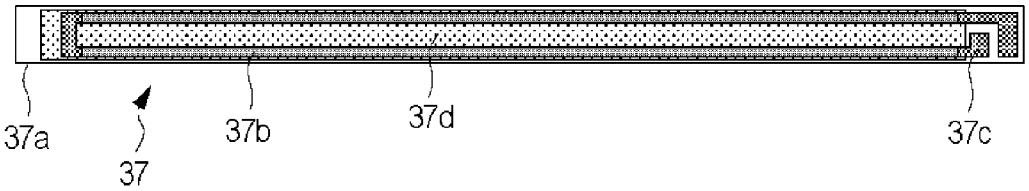

FIG. 3 is an illustration of a ceramic heater.

Figure 4:
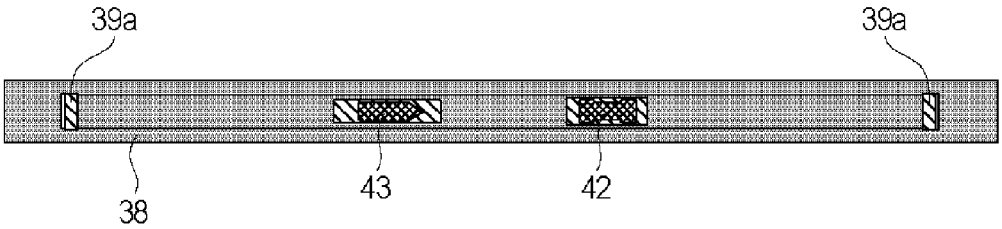

FIG. 4 is an illustration of a thermistor and a temperature fuse.

Figure 5:
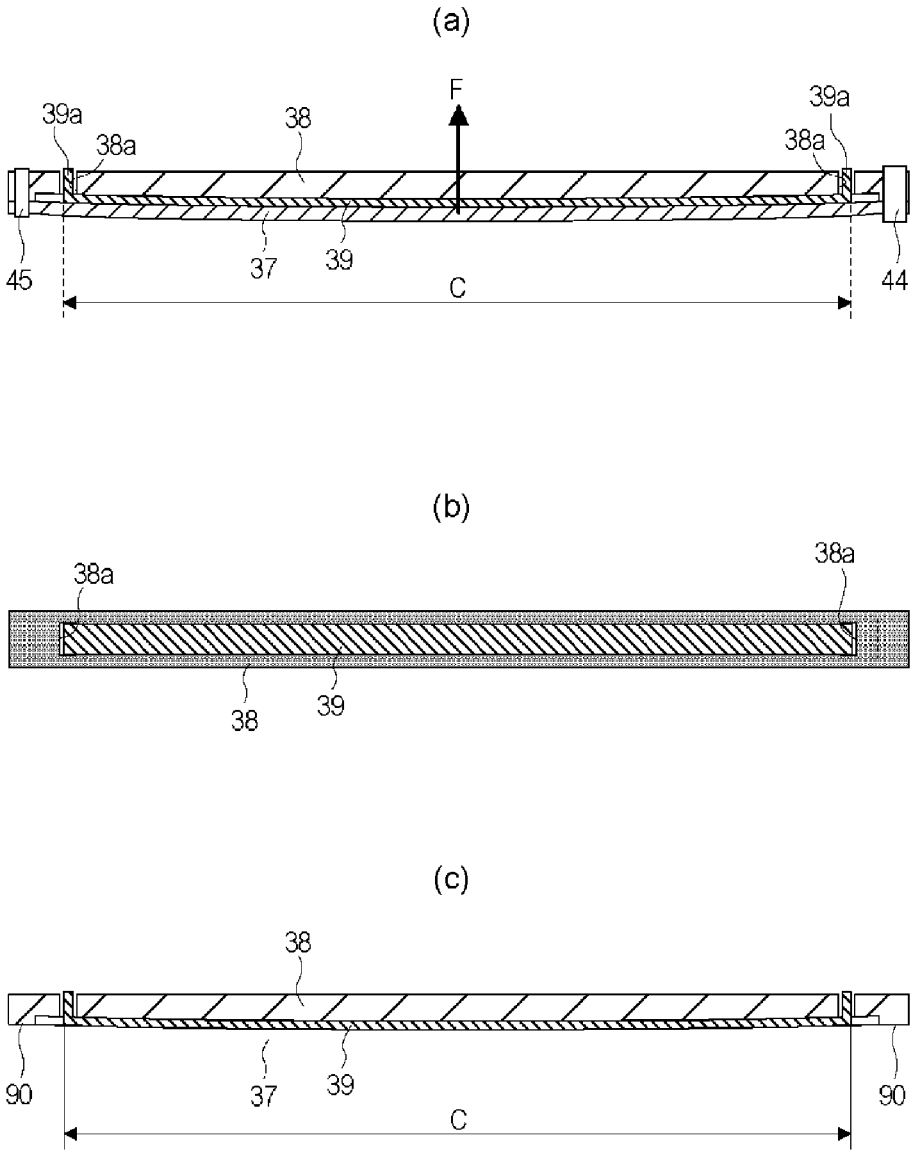

Part (a) of FIG. 5 is an illustration of a holding method of the heater and a metal plate in Embodiment 1, (b) of FIG. 5 is an illustration of the holding method of the metal plate in Embodiment 1, and (c) of FIG. 5 is an illustration of a relationship between the heater, a supporting member and the metal plate in Embodiment 1.

Figure 6:
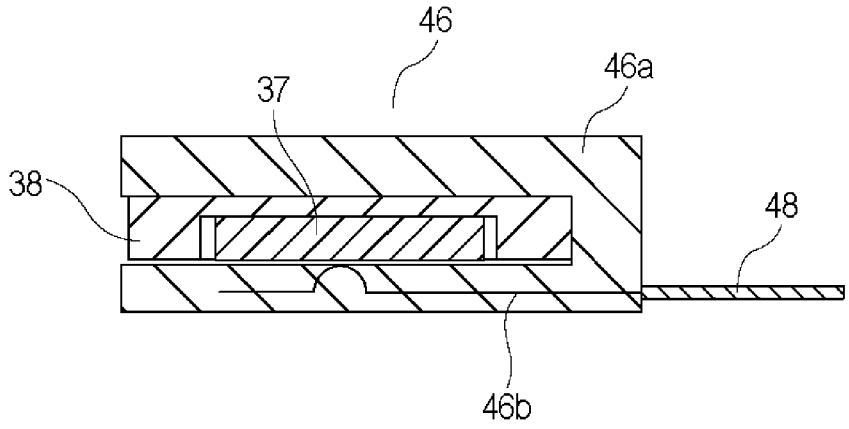
Figure 6:
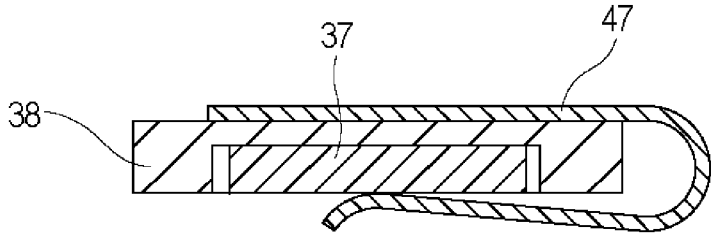

Part (a) of FIG. 6 is an illustration of an electric power supplying connector, and (b) of FIG. 6 is an illustration of a clip.

Figure 7:
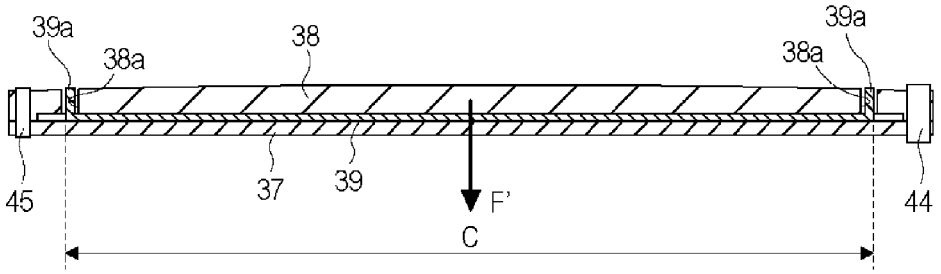

FIG. 7 is an illustration of the holding method of the heater and the metal plate in Embodiment 1.

Figure 8:
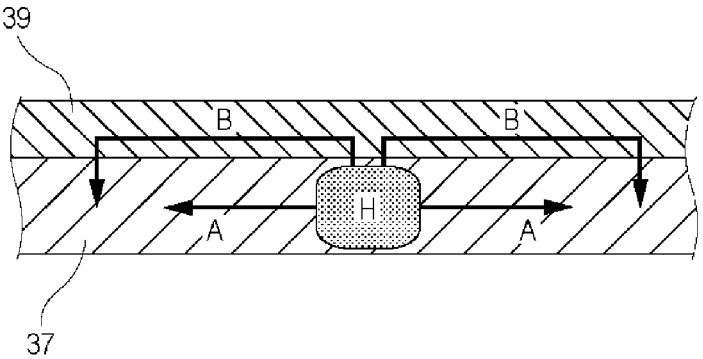

FIG. 8 is an illustration of flow of heat of the heater and the metal plate.

Figure 9:
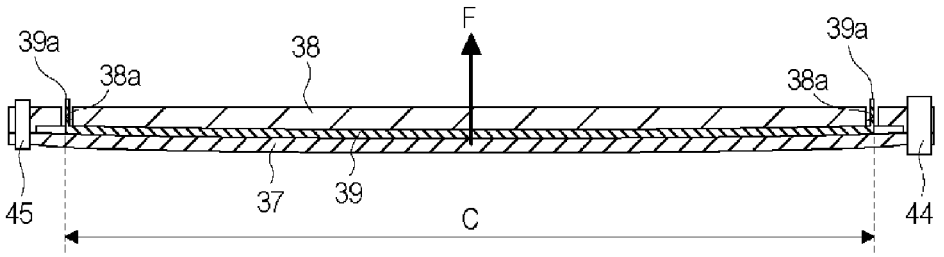

FIG. 9 is an illustration of a shape and structure of a metal plate in Embodiment 2.

Figure 10:
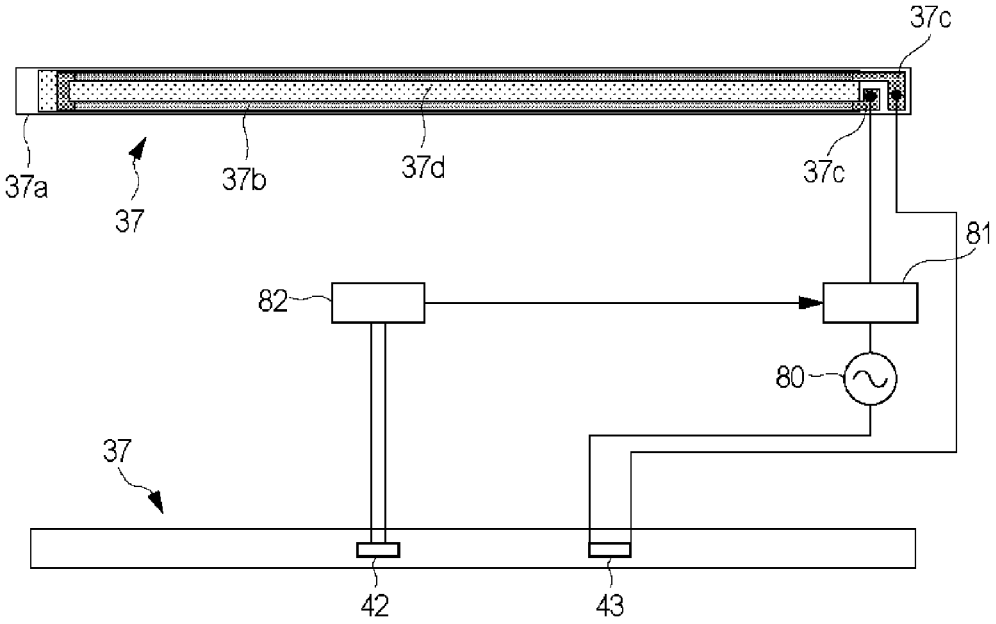

FIG. 10 is an illustration of a controller of the heater in Embodiment 1.

Figure 11:
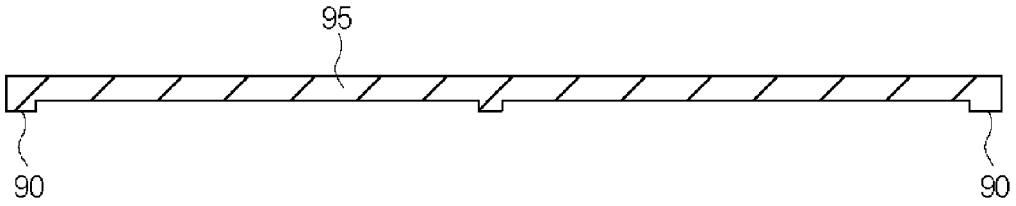
Figure 11:
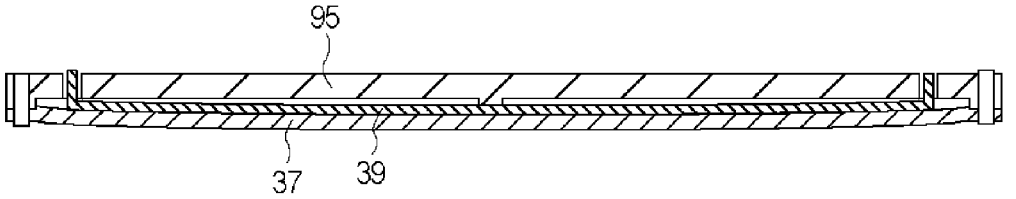

Part (a) of FIG. 11 is a supporting member in a modified embodiment of Embodiment 1, and (b) of FIG. 11 is an illustration of a holding method of a heater and a metal plate in the modified embodiment of Embodiment 1.

Figure 12:
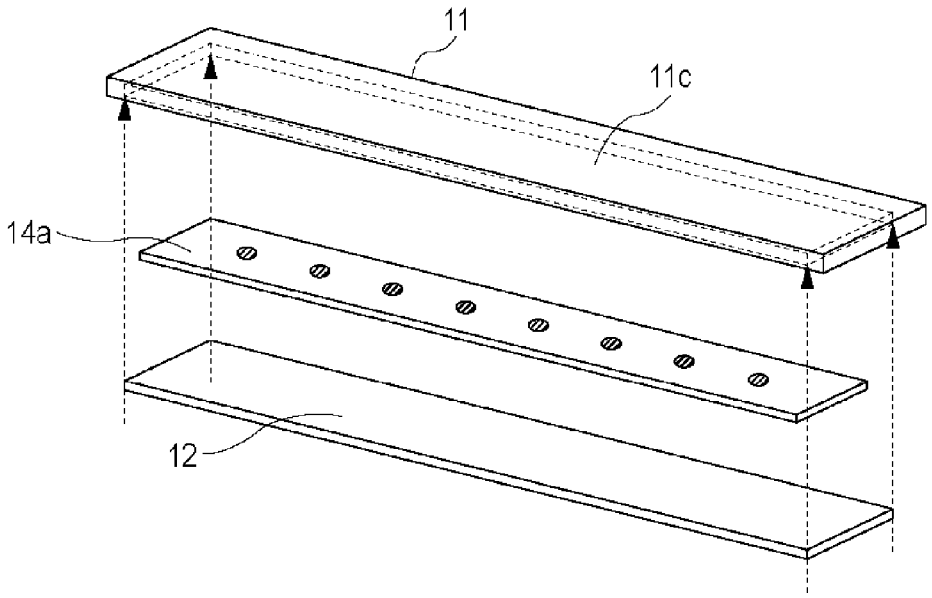
Fig. 12 Prior Art

FIG. 12 is an illustration of a heater and a metal plate in a conventional heating device.

Figure 13:
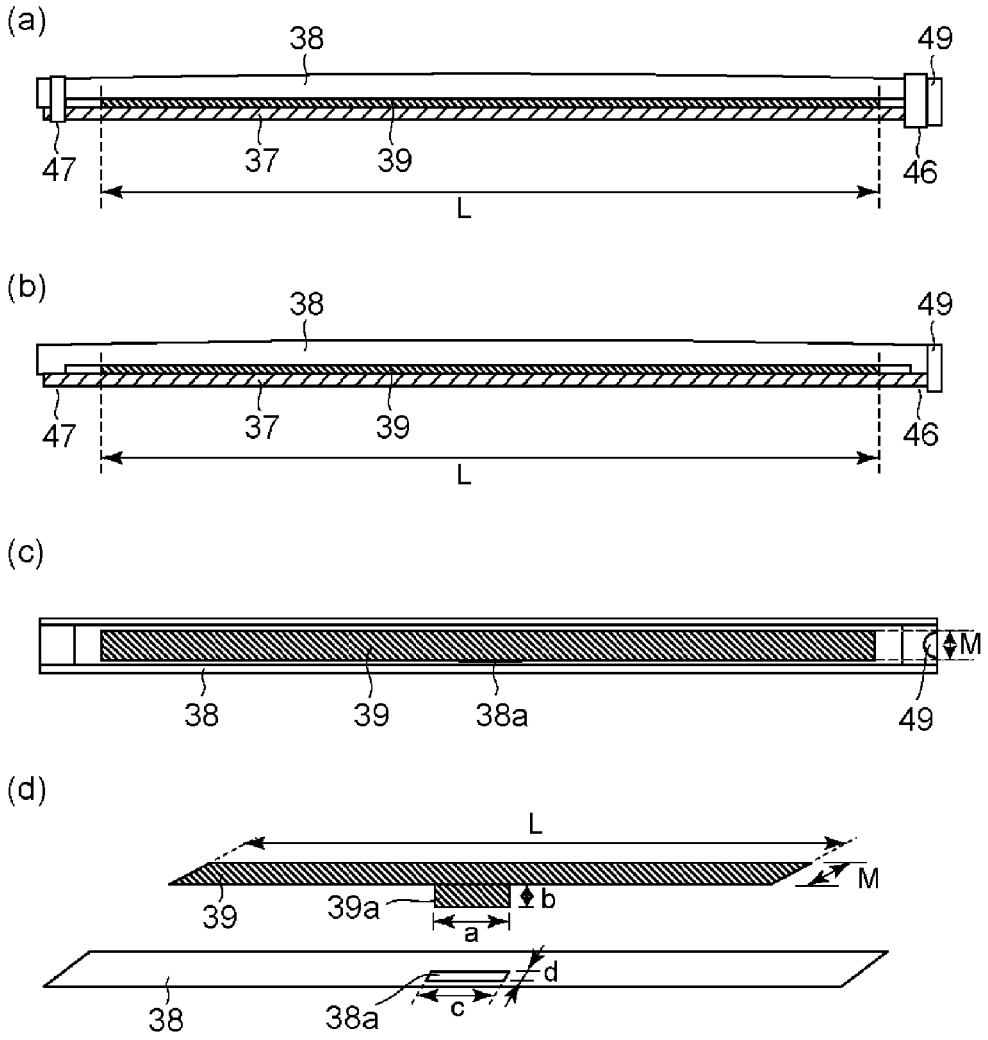

Part (a) of FIG. 13 is an illustration of a supporting method of a heater and a heat conduction member in Embodiment 3, (b) of FIG. 13 is an illustration in which an electric power supplying connector and a heater clip are omitted from illustration in (a) of FIG. 13, (c) of FIG. 13 is an illustration of the supporting method of the heat conduction member in Embodiment 3, and (d) of FIG. 13 is an illustration of a locking portion of the heat conduction member in Embodiment 3.

Figure 14:
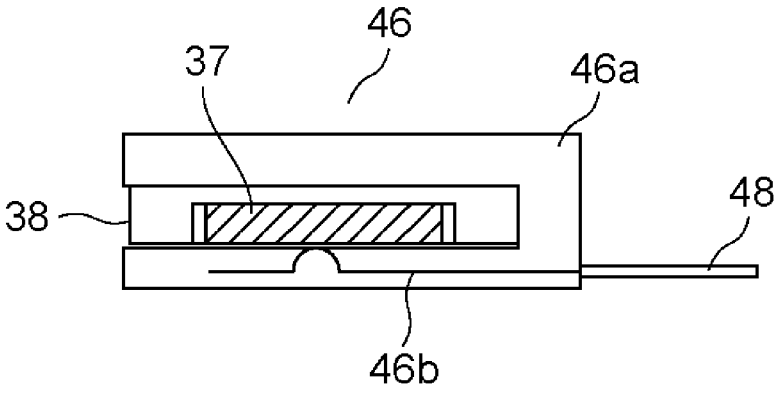
Figure 14:
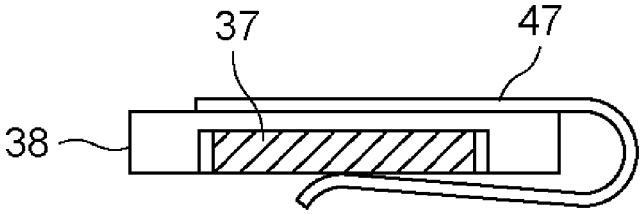

Parts (a) of FIG. 14 is an illustration of the electric power supplying connector in Embodiment 3, and (b) of FIG. 14 is an illustration of the heater clip in Embodiment 3.

Figure 15:
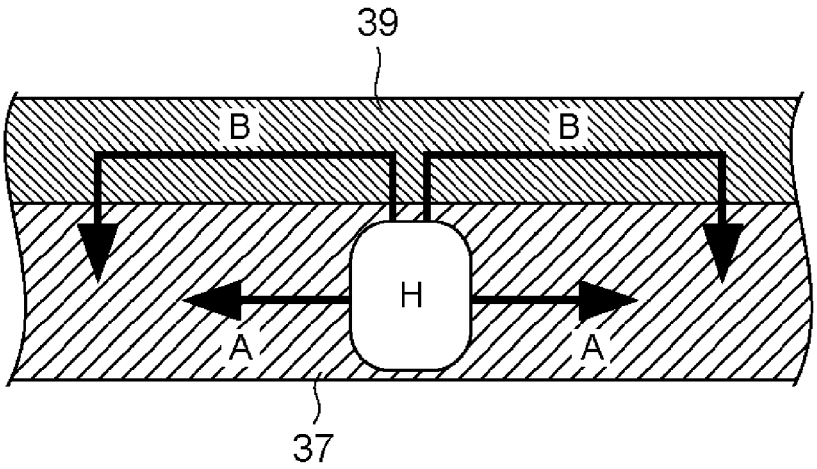
Figure 15:
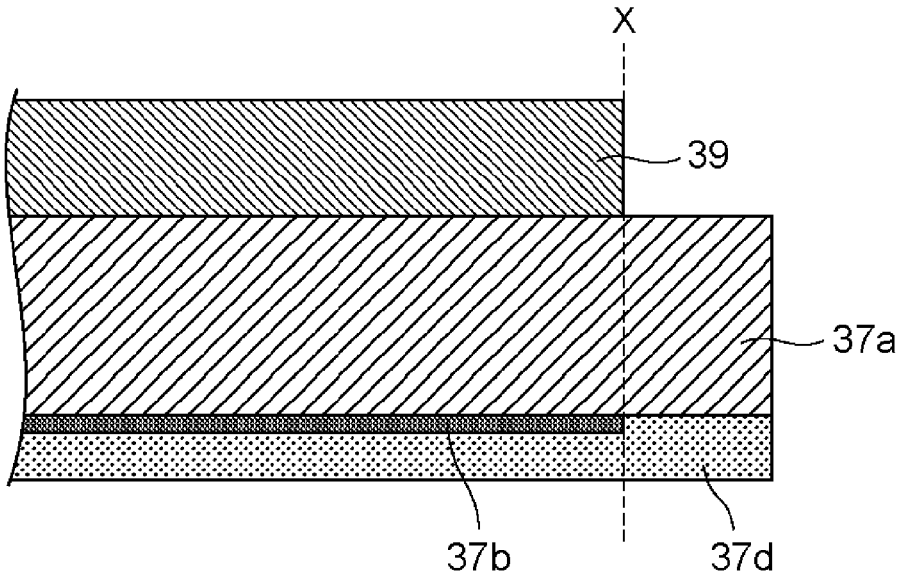

Part (a) of FIG. 15 is a partly enlarged view of the heater and the heat conduction member for illustrating flow of heat in the heater, and (b) of FIG. 15 is an enlarged view of end portions of the heater and the heat conduction member in Embodiment 3.

Figure 16:
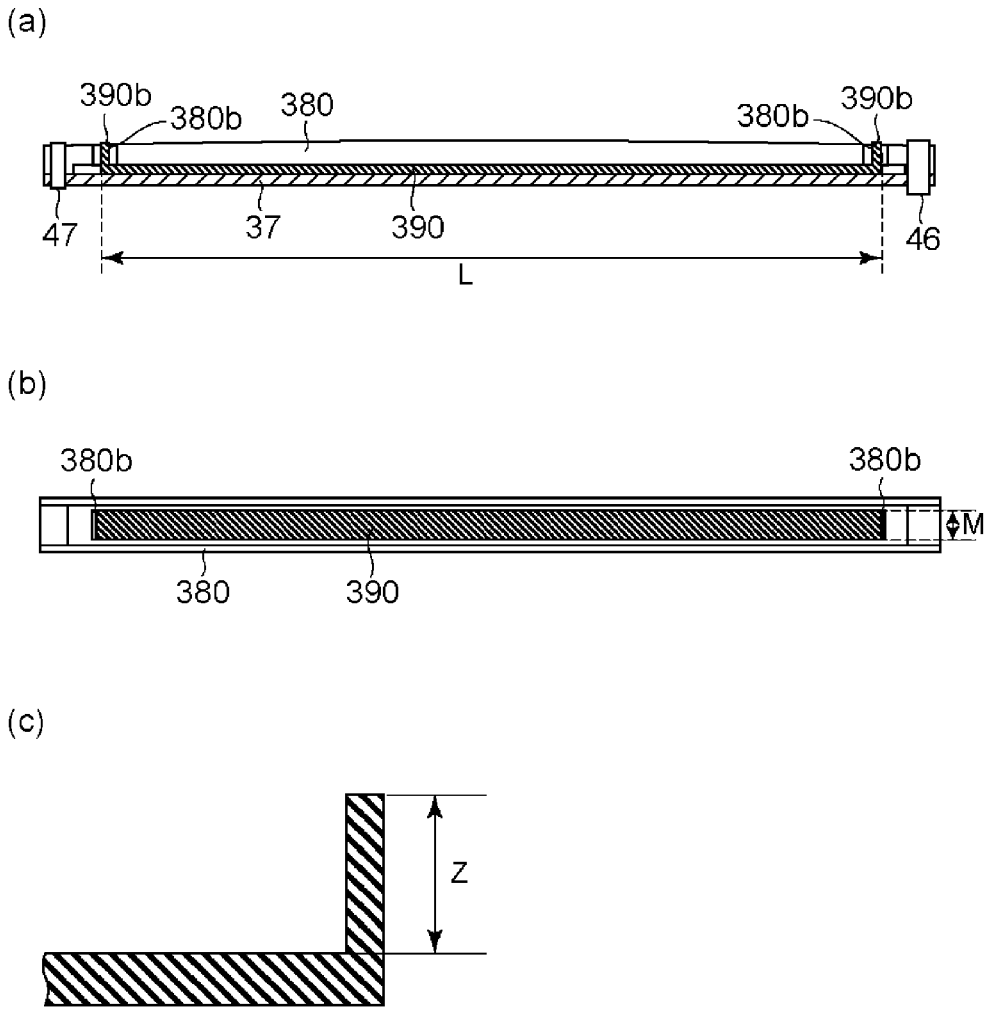

Part (a) of FIG. 16 is a schematic view for illustrating a supporting method of a heater and a heat conduction member in Comparison example, (b) of FIG. 16 is an illustration of the supporting method of the heat conduction member in Comparison example, and (c) of FIG. 16 is an enlarged view of a bent portion of the heat conduction member in Comparison example.

Figure 17:
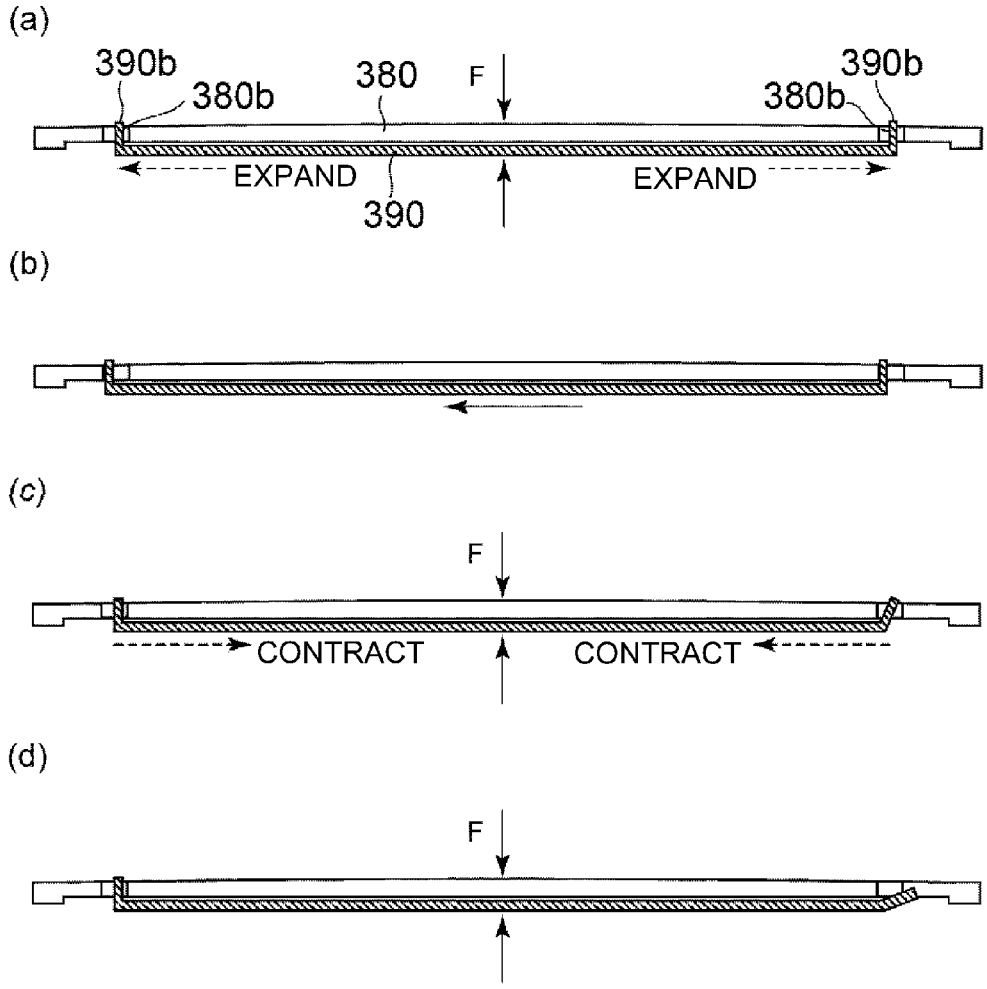

Parts (a) to (d) of FIG. 17 are illustrations of a deforming process of the heat conduction member in Comparison example.

Figure 18:
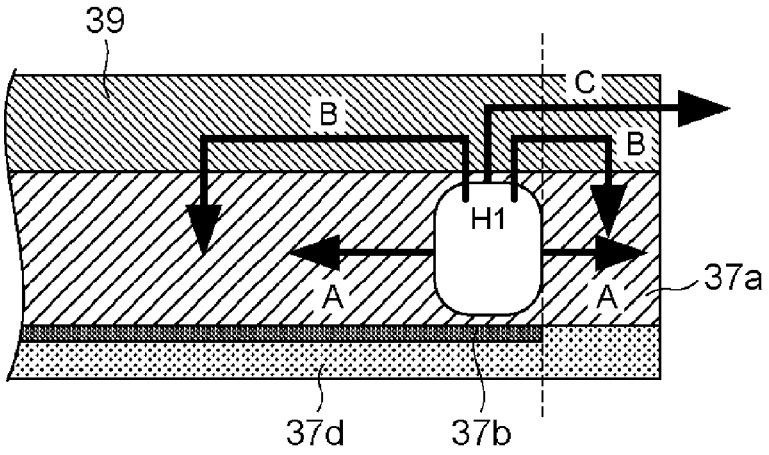
Figure 18:
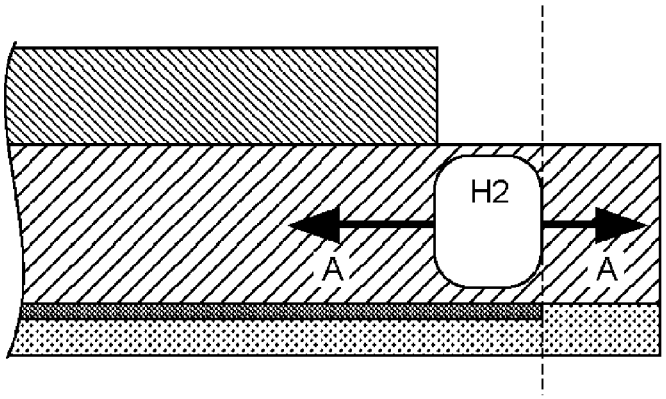

Parts (a) and (b) of FIG. 18 are illustrations each showing flow of heat at a longitudinal end portion of a heater.

Figure 19:
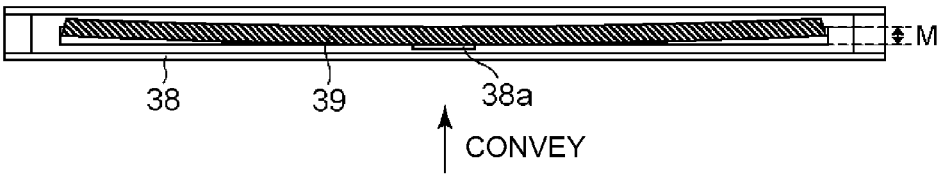

FIG. 19 is an illustration of deformation of the heat conduction member.

Figure 20:
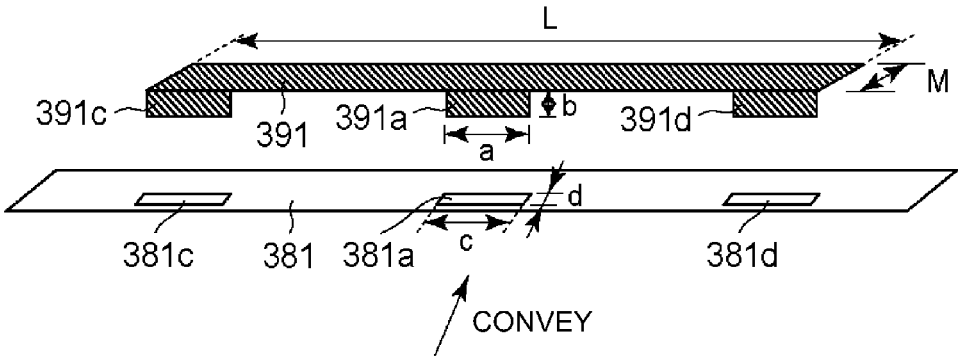

FIG. 20 is an illustration of a locking portion of a heat conduction member in Embodiment 4.

Figure 21:
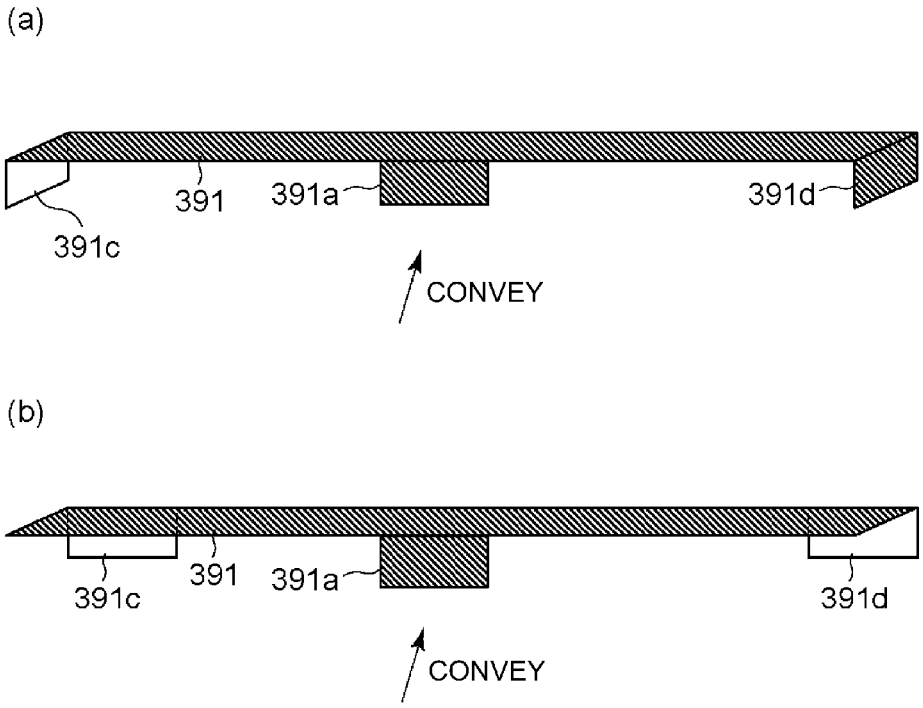

Parts (a) and (b) of FIG. 21 are illustrations each showing a heat conduction member in a modified embodiment in Embodiment 4.

Figure 22:
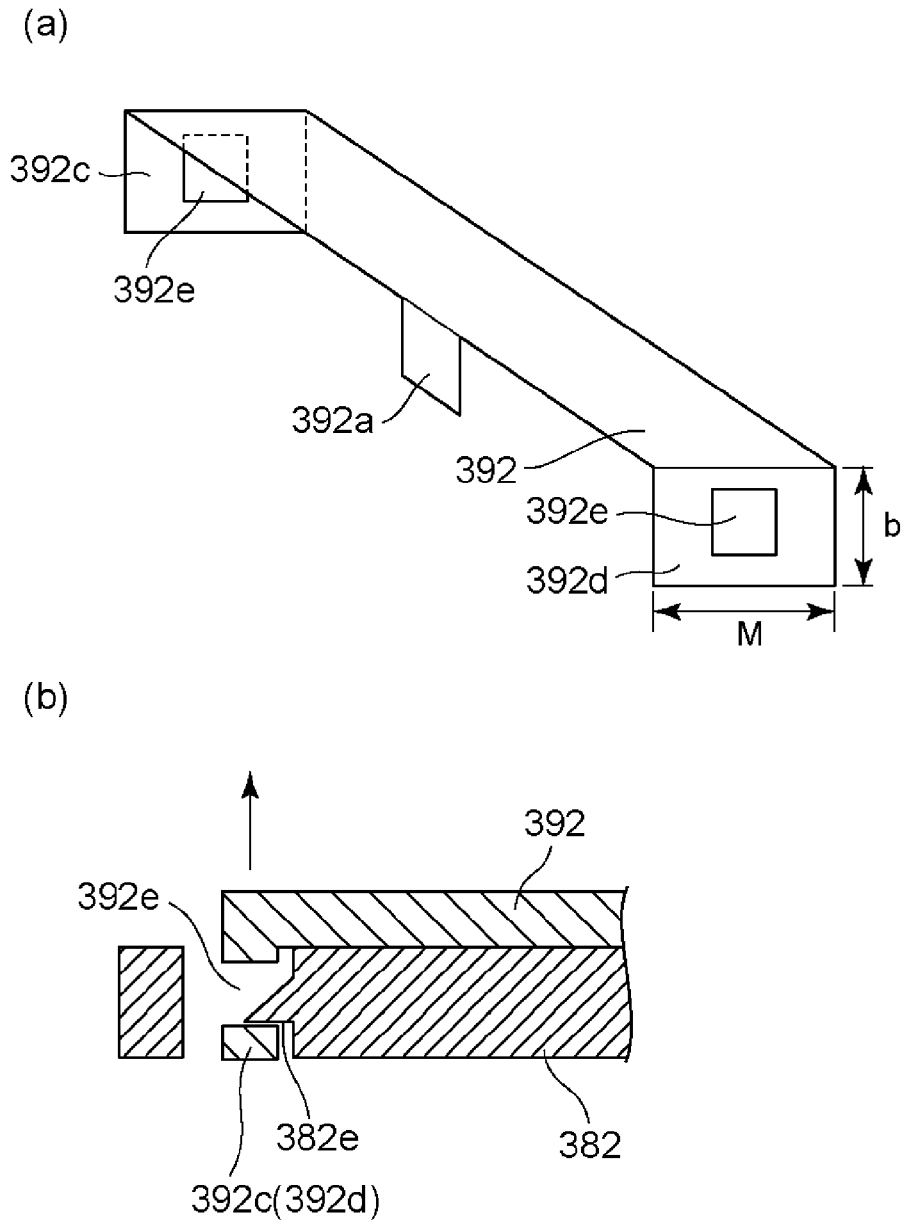

Part (a) of FIG. 22 is an illustration of a heat conduction member in Embodiment 5, and (b) of FIG. 22 is an illustration of engagement between the heat conduction member and a supporting member in Embodiment 5.

DESCRIPTION OF THE EMBODIMENTS

Embodiments of the present invention will be described below with reference to the drawings. First, a summary of a fixing device in an embodiment will be described and then a (characteristic) feature of the embodiment will be described.

Embodiment 1

In the following description of a device structure, a direction refers to a direction perpendicular to a recording material feeding direction in a recording material feeding path. A widthwise direction is the same direction as the recording material feeding direction.

Figure 1:
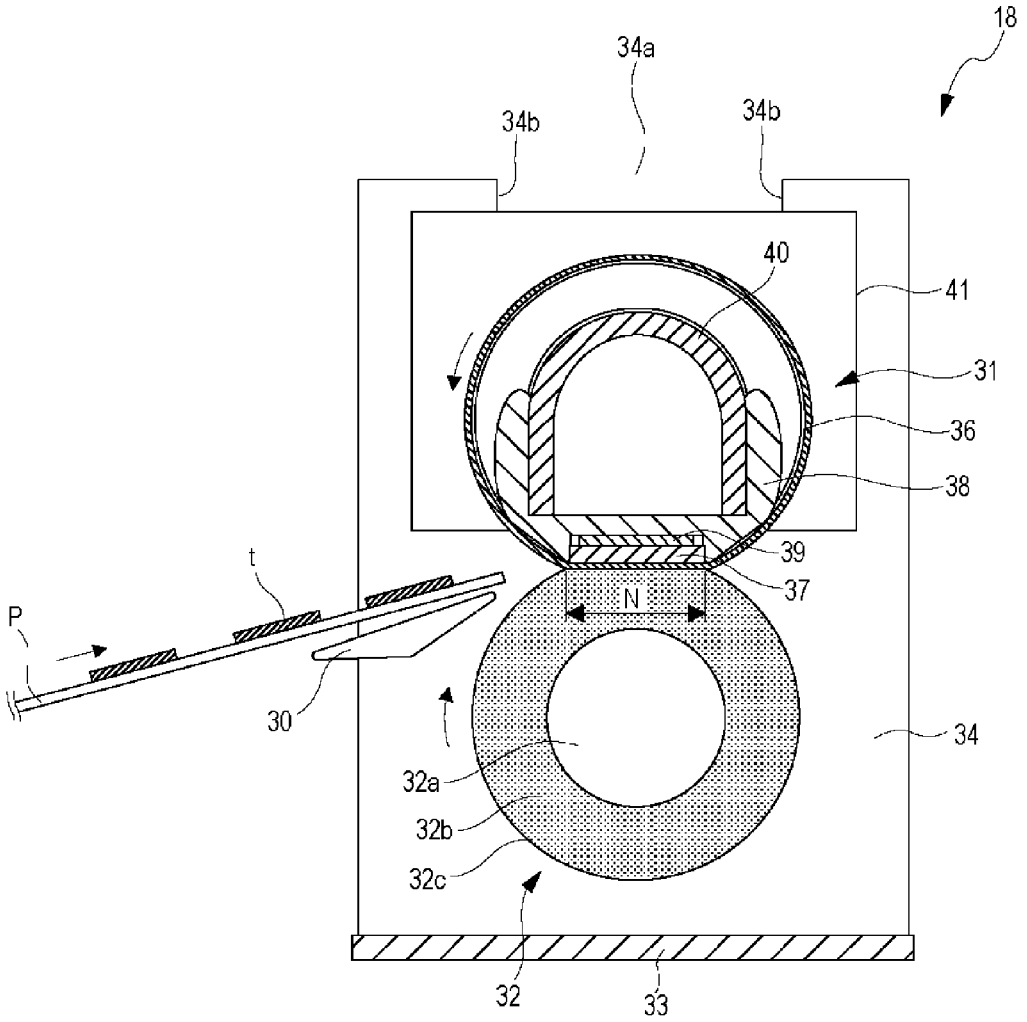
FIG. 1 is a sectional view for illustrating a structure of a fixing device in Embodiment 1.

FIG. 1 is a schematic sectional view of a fixing device 18 in this embodiment as seen from the longitudinal direction of the fixing device 18, and FIG. 2 is a schematic view of the fixing device 18 as seen from the widthwise direction at an end portion of the fixing device 18.

The fixing device 18 includes a film unit 31 including a cylindrical film 36 having flexibility and includes a pressing roller 32 as a pressing member. The film unit 31 and the pressing roller 32 are provided in substantially parallel to each other between left and right side plates 34 of a device frame 33.

The pressing roller 32 includes a metal core 32*a*, an elastic layer 32*b* formed outside the metal core 32*a*, and a parting layer 32*c* formed outside the elastic layer 32*b*. As a material for the elastic layer 32*b*, silicone rubber, fluorine-containing rubber or the like is used. As a material for the parting layer, PFA (tetrafluoroethylene-perfluoroalkylvinyl ether copolymer), PTFE (polytetrafluoroethylene) or FEP (tetrafluoroethylene-hexafluoropropylene copolymer) or the like is used.

In this embodiment, the pressing roller 32 prepared by forming an about 3.5 mm-thick silicone rubber layer 32*b* on a stainless steel-made more metal 32*a* of 11 mm in outer diameter by injection molding and then by coating an outside of the layer 32*b* with an about 40 μm-thick PFA resin tube 32*c* was used. An outer diameter of the pressing roller 32 is 18 mm. A hardness of the pressing roller 32 may desirably be, from the viewpoints of ensuring of a nip N and durability, in a range of 40-70 degrees as measured by an Asker-C hardness meter under a load of 9.8 N. In this embodiment, the hardness is 54 degrees. A length of the elastic layer 32*b* of the pressing roller 32 with respect to a longitudinal direction is 226 mm. The pressing roller 32 is, as shown in FIG. 2, supported rotatably between the side plates 34 of the device frame via bearing members 35 at end portions of the metal core 32*a*. At an end portion of the pressing roller metal core 32*a*, a driving gear G is fixed. To the driving gear G, a rotational force is transmitted from a driving source (not shown), so that the pressing roller 32 is rotationally driven.

The film unit 31 shown in FIG. 1 includes the film 36, a planar heater 37 contacting an inner surface of the film 36, a supporting member 38 for supporting the heater 37, and a metal plate 39 as a heat conduction member. The film unit 31 further includes a pressing stay 40 for reinforcing the supporting member 38, flanges 41 for limiting movement of the film 36 in the longitudinal position, and the like.

The film 36 includes a base layer, an elastic layer formed outside the base layer and a parting layer formed outside the elastic layer, and is a cylindrical flexible member. The film 36 in this embodiment is 18 mm in outer diameter. As the base layer, a 60 μm-thick polyimide base material is used. As the elastic layer, an about 150 μm-thick silicone rubber layer is used. As the parting layer, a 15 mm-thick PFA resin tube is used. The supporting member 38 has, as shown in FIG. 1, a substantially semicircular trough-like shape in cross section and is a member, formed of a liquid crystal polymer or the like, having rigidity, a heat-resistant property and a heat-insulating property. The supporting member 38 has the function of supporting the inner surface of the film 36 externally fitted into the supporting member 38 and the function of supporting a surface of the heater 37.

The heater 37 is, as shown in FIG. 3, prepared by forming two heat generating resistors 37*h* of silver-palladium alloy or the like on a substrate 37*a* of a ceramic material such as alumina or aluminum nitride by screen printing or the like and then by connecting an electrical contact portion 37*c* of silver or the like with the heat generating resistors 37*b*. In this embodiment, the two heat generating resistors 37*b* are connected in parallel, and a resistance value is 18Ω. On the heat generating resistors 37*b*, a glass coat 37*d* as a protective layer is formed, whereby the heat generating resistors 37*b* are protected and a sliding property with the film 36 is improved. The heater 37 is provided along a generatrix direction of the film 36 while opposing a supporting surface of the supporting member 38.

FIG. 4 is a schematic view showing the supporting member 38, a thermistor 42 and a temperature fuse 43. The supporting member 38 is provided with a through hole though which each of the thermistor 42 as a thermosensitive device and the fuse 43 as a safety device is disposed so as to contact the metal plate 39. That is, the thermosensitive device is provided on the heat conduction member so as to sense heat of the heater 37 via the heat conduction member.

The thermistor 42 is prepared by providing a thermistor element in a casing via ceramic paper or the like for stabilizing a contact state with the heater 37 and then by coating the thermistor element with an insulating material such as a polyimide tape. The temperature fuse 43 is a part for detecting abnormal heat generation to block electric power supply to the heater 37 when the heater 37 causes abnormal temperature rise. The temperature fuse 43 is prepared by mounting a fuse element, which fuses at a predetermined temperature, in a cylindrical metal casing, and blocks a circuit for supplying electric power to the heater 37 when the fuse element is fused due to the abnormal temperature rise of the heater 37. A size of the temperature fuse 43 in this embodiment is about 10 mm in length of a metal casing portion contacting the heater 37 and is about 4 mm in width of the metal casing. The temperature fuse 43 is provided on the metal plate 39 via a heat conductive grease to float over the heater 37, thus preventing improper operation.

A controller for controlling the amount of electric power supply to the heater 37 will be described with reference to FIG. 10. A CPU 82 turns on a triac 81 to supply electric power from a commercial power source 80 to the heat generating resistors 37*b* via the electrical contact portion 37*c* of the heater 37 to increase the temperature of the heater 37. Then, the temperature of the heater 37 is detected by the thermistor 42, and an output of the thermistor 42 is A/D-converted and then is inputted into the CPU 82. The CPU 82 controls, on the basis of the inputted temperature information, the electric power to be supplied to the heat generating resistors 37*b* by the triac 81 through phase control or wave number control. That is, the CPU 82 controls, in the case where the detection temperature of the thermistor 42 is higher than a target temperature, the triac 81 so as to increase the temperature of the heater 37. Further, the CPU 82 controls, in the case where the detection temperature of the thermistor 42 is lower than the target temperature, the triac 81 so as to decrease the temperature of the heater 37. By such control, the temperature of the heater 37 can be kept at the target temperature. Further, the temperature fuse 43 is, as shown in FIG. 10, disposed so that the temperature fuse 43 can block, irrespective of the CPU 82, a current passing from the commercial power source 80 to the heater 37 when the heater 37 causes the abnormal temperature rise.

Next, the pressing stay 40 shown in FIG. 1 has a U-shape in cross section and is a long member extending in the generatrix direction of the film 36. The function of the pressing stay 40 is to enhance the flexural rigidity of the film unit 31. The pressing stay 40 in this embodiment is formed by bending a 1.6 mm-thick stainless steel plate.

Next, assembling of the film unit 31 will be described. The pressing stay 40 is, as shown in (a) of FIG. 2, a structure obtained by mounting the pressing stay 40 to the supporting member 38 on which the heater 37 is held is inserted into an inside of the film 36, and then the flanges 41 are mounted at left and right end portions of the pressing stay 40 with respect to the generatrix direction of the film 36.

As shown in FIG. 1, with respect to a direction in which the heater 37 of the film unit 31 opposes the pressing roller 32 via the film 36, the film unit 31 is provided between the left and right side plates 34 of the device frame 33. A vertical groove portion 41*a* of each of the left and right side flanges 41 is engaged with a vertical groove portion 34*a* of each of the left and right side plates 34 of the device frame 33. In this embodiment, as a material for the flanges 41, a liquid polymer (resin) is used.

Then, as shown in (a) of FIG. 2, a pressing spring 45 is provided between a pressing arm 44 and a pressing portion 41*b* of each of the left and right flanges 41. As a result, the heater 37 is urged toward the pressing roller 32 via the left and right flanges 41, the pressing stay 40, the supporting member 38 and the film 36. As a result, the heater 37 forms, together with the pressing roller 32, a nip N of about 6 mm between the film 36 and the pressing roller 32 against elasticity of the pressing roller 32.

In this embodiment, pressure of the pressing spring 45 is set so that a press-contact force between the film 36 and the pressing roller 32 is 160 N as a total pressure.

Then, to the driving gear G of the pressing roller 32, a rotational force is transmitted from an unshown driving source, so that the pressing roller 32 is rotationally driven in the clockwise direction in FIG. 1 at a predetermined speed. With the rotational drive of the pressing roller 32, the rotational force acts on the film 36 by a frictional force acting between the pressing roller 32 and the film 36 in the nip N. As a result, as shown in FIG. 2, the film 36 slides on a surface of the heater 37 while contacting the heater 37 and is rotated in the counterclockwise direction around the supporting member 38 by rotation of the pressing roller 32. Incidentally, onto an inner surface of the film 36, heat-resistant grease is applied, so that a sliding property of the inner surface of the film 36 with the heater 37 and the supporting member 38 is improved.

The film 36 is rotated and the electric power is supplied to the heater 37, and in a state in which the temperature of the heater 37 detected by the thermistor 42 reaches the target temperature, the recording material P is introduced. As entrance guide 30 performs the function of guiding the recording material P, on which a toner image t in an unfixed state is placed, so as to be directed toward the nip N.

Into the nip N, the recording material P carrying thereon the unfixed toner image t is introduced, and then a toner image-carrying surface of the recording material P is in close contact with the film 36 in the nip N and the recording material P is fed through the nip N. In this feeding process, the unfixed toner image t on the recording material P is heated and pressed by heat of the film 36 heated by the heater 37 to be fixed on the recording material P. The recording material P passing through the nip N is curvature-separated from the surface of the film 36 and then is discharged to an outside of the fixing device by an unshown discharging roller pair.

Further, a pressure releasing (eliminating) mechanism for spacing the film unit 31 from the pressing roller 32 as shown from (a) of FIG. 2 to (b) of FIG. 2 by rotating an unshown pressure releasing cam to move the flanges 41 in a direction spaced away from the pressing roller 32. A first object of performance of this operation is to facilitate jam clearance of the recording material P when jam of the recording material P occurs in the fixing device 18. A second object is to prevent image defect due to plastic deformation of the film 36 by the press-contact force in the nip N in a status in which rotation of the film 36 is stopped in a period such as during sleep.

That is, the fixing device 18 in this embodiment is switchable between a first state in which the press-contact force in the nip is set at a fixable press-contact force and a second state in which a press-contact state in the nip is eliminated or in which the press-contact force in the nip is set at a press-contact force smaller than the press-contact force in the first state.

In this embodiment, although the press-contact state in the nip is automatically eliminated by an unshown pressure releasing motor, a constitution in which the press-contact state in the nip is eliminated by manually rotating the pressure releasing cam may also be employed.

Feature of this Embodiment

A constitution, as a (characteristic) feature of this embodiment, of the fixing device 18 including the metal plate 39 as the heat conduction member will be described. Part (a) of FIG. 5 is a sectional view of the heater 37 and its peripheral members as seen from the recording material feeding direction, and (b) of FIG. 5 is a schematic view showing a state in which the metal plate 39 is provided on the supporting member 38 in a condition in which the heater 37 is removed. Incidentally, in FIG. 5, the thermistor 42 and the temperature fuse 43 are omitted from illustration. Part (c) of FIG. 5 will be described later.

In this embodiment, as the metal plate 39, an aluminum plate having a thickness of 0.3 mm constant with respect to the generatrix direction of the film 36 is used. A contact portion contacting the heater 37 has a straight shape of 226 mm in length with respect to the generatrix direction of the film 36 and 5 nm in width with respect to a direction perpendicular to the generatrix direction of the film 36. The metal plate 39 includes a bent portion 39*a* of 1.5 mm at each of end portions with respect to the generatrix direction of the film 36, and the bent portion 36*a* is inserted into a hole 38*a* of the supporting member 38. Incidentally, the hole 38*a* is provided in a somewhat large depth relative to the metal plate 39 in order to absorb and difference in linear expansion coefficient between the metal plate 39 and the supporting member 38, and therefore it is difficult to completely fix the metal plate 39 to the supporting member 38. Incidentally, as the material for the heat conduction member, aluminum is used in this embodiment, but it is possible to use a member, having a higher thermal conductivity than the substrate of the heater 37, such as a metal plate of copper or the like or a graphite sheet.

The substrate of the heater 37 in this embodiment has a rectangular parallelopiped shape which is 260 mm in length with respect to the generatrix direction of the film 36, 5.8 mm in width with respect to the direction perpendicular to the generatrix direction of the film 36, and 1.0 mm in thickness. Further, a material for the substrate in this embodiment is aluminum.

In this embodiment, the metal plate 39 is constituted so as to be bent, with respect to a load toner the recording material feeding path surface, easier than the supporting member 38 and the heater 37. That is, when Young' modulus is E (GPa) and geometrical moment of inertia is I ($m^4$), flexural rigidity EI ($N \cdot m^2$) is smaller than those of the heater 37 and the supporting member 38. Further, the flexural rigidity of the heater 37 is smaller than the flexural rigidity of the supporting member 38.

The metal plate 39 in this embodiment is constituted by aluminum, and has the Young's modulus of about 70 (GPa) and the geometrical moment of inertia of about 0.011 ($mm^4$), so that the flexural rigidity EI is about $7.9 \times 10^2$ ($N \cdot mm^2$). On the other hand, the heater 37 has the Young's modulus of about 350 (GPa) and the geometrical moment of inertia of about 0.483 ($mm^4$), so that the flexural rigidity EI is $1.7 \times 10^5$ ($N \cdot mm^2$). The liquid polymer used as the material for the supporting member 38 has the Young's modulus of about 13 (GPa) and the geometrical moment of inertia of about 29.4 ($mm^4$), so that the flexural rigidity EI is $3.8 \times 10^5$ ($N \cdot mm^2$). Incidentally, the cross-sectional shape of the supporting member 38 partly includes ribs which stand in actuality and is not uniform with respect to the generatrix direction of the film 36, and therefore the above values were shown as average values.

Here, the functions of the metal plate 39 will be described. The function of the metal plate 39 is such that the heater breaking (cracking) is suppressed by uniformizing the heat of the heater 37 during thermal runaway of the heater 37. When the thermistor 42, the fuse 43 and the like are directly contacted to the substrate of the heater 37, the heater 37 is broken (cracked) in some cases by thermal stress due to a temperature difference between a contact portion and a non-contact portion of these members during the thermal runaway of the heater 37. Therefore, as in this embodiment, by providing the thermistor 42 and the fuse 43 on the metal plate 39 contacting the heater 37, the heater breaking generated due to the thermal stress is not readily generated as a result of heat uniformization of the substrate of the heater 37 during the thermal runaway of the heater 37.

The heat uniformization of the heater 37 will be described with reference to FIG. 8. The thermal conductivity of the alumina used as the material for the substrate 37*a* of the heater 37 is about 26 W/mK. On the other hand, the aluminum used as the material for the metal plate 39 is about 230 W/mK, which is larger than the thermal conductivity of the substrate 37*a*. Here, as shown in FIG. 8, the case where a certain portion H of the substrate 37*a* with respect to the generatrix direction of the film 36 is higher in temperature than another portion will be considered. In addition to flow A of heat in the substrate 37*a* with respect to the generatrix direction of the film 36, flow of heat from the substrate 37*a* to the metal plate 39 is generated at a portion, of the substrate 37*a*, where the substrate 37*a* contacts the metal plate 39. Further, in the metal plate 39, flow B of heat returned toward the substrate 37*a* with respect to the generatrix direction of the film 36 is generated. By this action, the heat of the heater 37 is uniformized.

Next, a shape of a supporting surface of the supporting member 38 which supports the heater 37 via the metal plate 39 will be described. As shown in (a) of FIG. 5, a region C in which the above supporting surface is projected toward the pressing roller 32 at a central portion more than at end portions with respect to the generatrix direction of the film 36 is provided. The region C in this embodiment has a moderately curved shape such that the supporting surface gradually approaches the pressing roller 32 from the end portions toward the central portion with respect to the generatrix direction of the film 36 (hereinafter, referred to as a crown shape). A length of the C with respect to the generatrix direction of the film 36 is 226 mm which is the same as the length of the pressing roller 32, and the amount of projection at the central portion relative to the end portions in the region C with respect to the generatrix direction of the film 36 is 0.6 mm.

Next, a constitution of, as a limiting member, an electric power supplying connector 46 and a clip 47 will be described with reference to FIG. 6. In this embodiment, by using the electric power supplying connector 46 or the clip 47, a contact state of the heater 37 with the supporting member 38 at each of the end portions with respect to the generatrix direction of the film 36 is maintained.

The electric power supplying connector 46 includes a housing portion 46*a* formed of a recording material in a U-shape and includes a contact terminal 46*b* ((a) of FIG. 6). The housing portion 46*a* sandwiches the heater 37 and the supporting member 38 from the outsides thereof, thus illustrating movement of the end portions of the heater 37, with respect to the generatrix direction of the film 36, in a thickness direction of the heater 37 relative to the supporting member 38. Further, the contact terminal 46*b* elastically contacts the electrical contact portion 37*c* of the heater 37 at a pressing roller contact pressure to maintain electrical connection with the heater 37. Further, the contact terminal 46*b* is connected to a bundle wire 48, and the bundle wire 48 is connected with the commercial power source 80 and the triac 81 shown in FIG. 10. Incidentally, the housing portion and the contact terminal may also be constituted as separate members.

The clip 47 is U-shaped metal plate, and elastically sandwiches the heater 37 and the supporting member 38 from outsides thereof, thus limiting movement of the end portions of the heater 37, with respect to the generatrix direction of the film 36, in the thickness direction of the heater 37 relative to the supporting member 38 ((b) of FIG. 6).

Further, the electric power supplying connector 46 and the clip 47 limit the movement of the end portions of the heater 37, with respect to the generatrix direction of the film 36, in the thickness direction of the heater 37 relative to the supporting member 38, and are constituted so as to be movable in a direction parallel to the surface of the heater 37. Accordingly, application of unnecessary stress to the heater 37 is prevented during an occurrence of the thermal expansion of the heater 37 and an occurrence of flexure during pressure application and spacing.

Action of this Embodiment

The action of this embodiment is such that even in a state in which the press-contact state in the nip is eliminated or in which the press-contact force in the nip is alleviated, the heater 37 and the metal plate 39 are stably contacted to each other.

A mechanism of this action will be described with reference to FIG. 5. Incidentally, in order to facilitate visualization, in (c) of FIG. 5, only a portion including the supporting member 38, the metal plate 39 and the heater 37 is shown. In this embodiment, a portion of the heater 37 corresponding to the region C is supported by the supporting surface, having the crown shape, of the supporting member 38 via the metal plate 39, and the end portions of the heater 37 with respect to the generatrix direction of the film 36 are contacted to and supported by end portion supporting surfaces 90.

The movement of the heater 37 in the thickness direction relative to the supporting member 38 at the end portions of the heater 37 with respect to the generatrix direction of the film 36 in this embodiment is limited by the electric power supplying connector 46 or the like. Accordingly, a position of the heater 37 relative to the supporting member 38 with respect to the thickness direction at the end portions of the heater 37 is not changed even in a state in which the press-contact force in the nip is set at a fixable press-contact force and even in a state in which the press-contact state in the nip is eliminated or in which the press-contact force in the nip is alleviated.

Further, when the metal plate 39 is mounted on the supporting surface, having the crown shape, of the supporting member 38, a surface of the metal plate 39 to which the heater 37 is contacted at the central portion with respect to the generatrix direction of the film 36 is projected more than the end portion supporting surfaces 90 to which the heater 37 is contacted at the end portions with respect to the generatrix direction of the film 36. That is, the heater 37 is in a state in which the movement in the thickness direction thereof at the end portions with respect to the generatrix direction of the film 36 is limited, and is in a state in which the heater 37 is pressed and deformed in a direction, in which the heater 37 approaches the pressing roller, at the central portion with respect to the generatrix direction of the film 36. Accordingly, a restoring force F for restoring a shape of the heater 37 to the original straight shape is generated with respect to the heater 37 itself. The flexural rigidity in this embodiment satisfy: (flexural rigidity of metal plate 38)<(flexural rigidity of heater 37)<(flexural rigidity of supporting member 38), and therefore by the restoring force F of the heater 37, the metal plate 39 is stably contacted to the supporting member 38 while contacting the heater 37 and following the crown shape of the supporting member 38. This stable contact state between the metal plate 39 with the supporting member 38 and the heater 37 is generated by the restoring force of the heater itself, and therefore is not changed even in a state in which the press-contact state in the nip is eliminated or in which the press-contact force in the nip is alleviated.

Here, a magnitude of the restoring force F in this embodiment was measured. When a load required for flexing the heater 37 from the straight shape at the central portion of the supporting member 38 with respect to the generatrix direction of the film 36 by 0.6 mm was measured, as a simple center load, 0.42 N was obtained. In this embodiment, the crown shape of the supporting member 38 is a moderately curved shape, and therefore the heater 37 is, in actuality, in a state close to a uniform load state, so that the restoring force F of 0.42 N or more is generated over the entire heater 37 with respect to the generatrix direction of the film 36. Accordingly, even in a pressure-released state in which the press-contact force in the nip of the fixing device 18 is eliminated or alleviated, the heater 37 is stably contacted to the metal plate 39 by the restoring force F of the heater 37 itself.

Incidentally, the supporting member 38 is backed up by the pressing stay 40 having the high flexural rigidity, and therefore flexure of the supporting member 38 due to the restoring force F of the heater 37 is not generated. Even in the case where the supporting member 38 is not backed up by the pressing stay 40, when the flexural rigidity of the supporting member 38 is sufficiently larger than the flexural rigidity of the heater 37, the heater 37 is flexed to generate the restoring force F. Further, in the case where the flexural rigidity of the supporting member 38 is smaller than the flexural rigidity of the heater 37, as shown in FIG. 7, the supporting member 38 is deformed upward in the figure by the crown shape thereof. In this case, by a restoring force F' of the supporting member 38, the metal plate 39 is pressed toward the heater 37, but the flexural rigidity of the metal plate 39 is small and therefore does not resist the restoring force F' of the supporting member 38, so that a contact property between the metal plate 39 and the heater 37 can be ensured. In the case where the flexural rigidity of the heater 37 and the flexural rigidity of the supporting member 38 are approximately the same, both of the heater 37 and the supporting member 38 are flexed, and thus a shape such that the restoring force F of the heater 37 and the restoring force F' of the supporting member 38 are balanced with each other, so that the contact property between the metal plate 39 and the heater 37 is ensured.

As described above, according to this embodiment, even in the state in which the press-contact state in the nip is eliminated or in which the press-contact force in the nip is alleviated, the heater 37 and the metal plate 39 are contacted to each other stably.

For that reason, an effect of uniformizing the temperature distribution of the heater 37 by the metal plate 39 can be sufficiently achieved, so that the heater breaking can be suppressed.

Incidentally, in this embodiment, the supporting surface of the supporting member 38 has the crown shape in the region C, but the supporting member 38 may only be required to have a projected shape such that in the region C, the central portion is projected more than the end portions with respect to the generatrix direction of the film 36. A modified embodiment of Embodiment 1 is shown in FIG. 11. Part (a) of FIG. 11 shows a supporting member 95 in this modified embodiment, and (b) of FIG. 11 shows a structure in which the supporting member 38 in Embodiment 1 is replaced with the supporting member 95. Also in this modified embodiment, the heater 37 is a state in which the movement of the heater 37 in the thickness direction at the end portions thereof with respect to the generatrix direction of the film 36 is limited, and is in a state in which the central portion of the heater 37 with respect to the generatrix direction of the film 36 approaches the pressing roller 32. Accordingly, similarly as in Embodiment 1, the restoring force acts on the heater 37, so that the heater 37 and the metal plate 39 are stably contacted to each other.

However, in the constitution of Embodiment 1, the heater 37 to which the press-contact force is applied in the state in which the press-contact force in the nip Ni is set at the fixable press-contact force is backed up by the supporting member 38 via the metal plate 39 over the longitudinal direction, and therefore the constitution of Embodiment 1 has an advantage such that the pressure in the nip N is stabilized.

Embodiment 2

In this embodiment, different from Embodiment 1 in which the crown shape is provided at the supporting surface of the supporting member 38, a constitution in which the crown shape is provided at an opposing surface, of the metal plate 39, to the heater 37 is employed. The metal plate 39 is, similarly as in Embodiment 1, constituted by aluminum. A difference between this embodiment and Embodiment 1 is only the supporting member 38 and the metal plate 39, and other constitutions are substantially the same as those in Embodiment 1 and therefore will be omitted.

A feature of this embodiment will be described. The metal plate 39 has, as shown in FIG. 9, a shape such that a central portion thereof with respect to the generatrix direction of the film 36 is projected more than end portions in a direction in which the metal plate 39 approaches the heater 37. The metal plate 39 has a crown shape which is a moderately curved shape such that the metal plate 39 gradually approaches the heater 37 from the end portions toward the central portion with respect to the generatrix direction of the film 36. The length of the metal plate 39 with respect to the generatrix direction of the film 36 and the dimension of the metal plate 39 with respect to the direction perpendicular to the generatrix direction of the film 36 are the same as those in Embodiment 1. The thickness of the metal plate 39 is 0.2 mm at the end portions and 0.8 mm at the central portion with respect to the generatrix direction of the film 36. In a state in which the heater 37 is mounted to the supporting member 38, with respect to the thickness direction of the heater 37, there is a portion where the surface of the metal plate 39 is projected more than the end portion supporting surfaces 90 of the heater 37, and the amount of the projection is similar to that in Embodiment 1. Therefore, a restoring force F generated with respect to the heater 37 is similar to that in Embodiment 1.

As a result, also in Embodiment 2, the heater 37 and the metal plate 39 are stably contacted to each other even in the state in which the press-contact force is set at the fixable press-contact force or even in the state in which the press-contact state in the nip is eliminated or in which the press-contact force in the nip is alleviated.

An effect in this embodiment different from the effect in Embodiment 1 will be described. The plate 39 is subjected to bending in L-shape at each of the end portions thereof with respect to the generatrix direction of the film 36, and therefore heat of the heater 37 is liable to be dissipated from the end portions during fixing, so that a temperature decrease at the end portions of the film 36 with respect to the generatrix direction of the film 36 is generated in some cases. Therefore, with respect to the generatrix direction of the film 36, the thickness of the metal plate 39 is made thinner at the end portions than at the central portion, such an effect that the heat at the end portions is not readily dissipated is achieved.

In this embodiment, the thickness of the p 39 is changed with respect to the generatrix direction of the film 36, whereby the crown shape is formed, and thus it is possible to achieve a heat-uniformizing effect of the heater 37 while suppressing the end portion temperature lowering of the heater 37 with respect to the generatrix direction of the film 36.

Incidentally, in this embodiment, a constitution in which the crown shape is formed on both of the supporting member 38 and the metal plate 39 may also be employed.

Embodiment 3

A fixing device 18 according to this embodiment is the same as the fixing device 18 in Embodiment 1 except for a heat conduction member 39 and a supporting member 38 and therefore will be omitted from description. With reference to FIG. 5, the heat conduction member 39 in this embodiment will be described.

The heat conduction member 39 is formed with an aluminum plate. Part (a) of FIG. 13 is a sectional view of an assembly of the supporting member 38 with the heat conduction member 39 and the heater 37 as seen from a widthwise direction, (b) of FIG. 13 is a sectional view of the assembly of (a) of FIG. 13 from which the electric power supplying connector 46 and the heater clip 47 are omitted from illustration, (c) of FIG. 13 is a top (plan) view of the assembly of the supporting member 38 with the heat conduction member 39, and (d) of FIG. 13 is a perspective view of the supporting member 38 and the heat conduction member 39.

In this embodiment, as shown in (a) of FIG. 13, the supporting member 38 is provided with the heater 37 via the heat conduction member 39. The end portions of the heater 37 with respect to a direction perpendicular to the recording material feeding direction are held by the supporting member 38 with, as a holding member, the electric power supplying connector 46 and the heater clip 47, respectively. Further, the end portion of the heater 37 with respect to the direction perpendicular to the recording material feeding direction contacts a limiting surface (limiting portion) 49 of the supporting member 38 as shown in (c) of FIG. 13. As shown in (b) of FIG. 13, with respect to the direction perpendicular to the recording material feeding direction, the central portion of the heater 37 is supported by the supporting member 38 via the heat conduction member 39, and the end portions of the heater 37 are supported by the supporting member 39 in contact with the supporting member 39.

The electric power supplying connector 46 includes, as shown in (a) of FIG. 14, a U-shaped housing portion 46*a* formed of a resin material and a contact terminal 46*b*. The electric power supplying connector 46 has the function of sandwiching and holding the heater 37 and the supporting member 38 and has the function of supplying the electric power to the heat generating resistor 37*b* by bringing the contact terminal 46*b* into contact with the electrode 37*c* of the heater 37 shown in FIG. 3. Incidentally, a member for supplying the electric power to the heater 37 and a member for holding the heater 37 and the supporting member 38 may also be constituted by separate members.

The contact terminal 46*b* is connected with the AC power source and a triac (not shown) via a bundle wire 48. The heater clip 47 is, as shown in (b) of FIG. 14, formed with a metal plate bent in a U-shape, and by elasticity thereof, a contact state of the end portion of the heater 37 with the supporting member 38 is kept. Movement of the heater 37 in the thickness direction of the heater 37 relative to the supporting member 38 is limited by the heater clip 47. On the other hand, with respect to the direction perpendicular to the recording material feeding direction, the end portion of the heater 37 opposite from the end portion of the heater 37 heated by the limiting surface 49 of the supporting member 38 is not limited by the supporting member 38, thus being capable of absorbing the thermal expansion and contraction of the heater 37.

With reference to (d) of FIG. 13, a locking portion of the heat conduction member 39 which is a feature of this embodiment will be described. In this embodiment, as the heat conduction member 39, a 0.3 mm-thick aluminum plate is used. The heat conduction member is, in a contact region where the heat conduction member 39 contacts the heater 37, 222 mm in width L with respect to the direction perpendicular to the recording material feeding direction and is 5 mm in width M with respect to the recording material feeding direction. The heat conduction member 39 includes, as the locking portion, a bent portion 39*a* at a portion which is not only the central portion with respect to the direction perpendicular to the recording material feeding direction but also the end portion with respect to the recording material feeding direction. The bent portion 39*a* is 8 mm in width a with respect to the direction perpendicular to the recording material feeding direction and is 3 mm in projection amount b from an opposing surface, of the heat conduction member 39*a* to the supporting member 38, toward the side where the supporting member 38 is provided. The heat conduction member 39 is locked with respect to a direction perpendicular to the recording material feeding direction by inserting the bent portion 39*a* into a hole 38*a* as a locked portion provided in the supporting member 38. Incidentally, the hole 38*a* is formed so as to be somewhat larger than the bent portion 39*a* in order to absorb the thermal expansion of the heat conduction member 39. The hole 38*a* has a size of 8.1 mm in width c with respect to the direction perpendicular to the recording material feeding direction and of 0.4 mm in width d with respect to the recording material feeding direction. The heat conduction member 39 has play, relative to the supporting member 38, of 0.1 mm with respect to the direction perpendicular to the recording material feeding direction.

In this embodiment, the shape of the supporting surface, of the supporting member 38, where the supporting member 38 supports the heater 37 via the metal plate 39 may be the crown shape similarly as in Embodiment 1 and may also be a shape of a flat surface parallel to the surface of the metal plate 39.

The substrate 37*a* in this embodiment has a shape of a rectangular parallelopiped of 270 mm in width with respect to the direction perpendicular to the recording material feeding direction, 5.8 mm in width with respect to the recording material feeding direction, and 1.0 mm in this embodiment, and is formed of alumina. Further, the heat generating resistor 37*b* is 222 mm in length with respect to the direction perpendicular to the recording material feeding direction, and the length is the same as the width of the contact region of the heat conduction member 39 with the heater 37.

Action in this Embodiment

A mechanism for uniformizing the heat of the heater 37 with respect to the direction perpendicular to the recording material feeding direction in a status in which a small-sized recording material is continuously subjected to fixing to generate non-sheet-passing portion temperature rise will be described.

In this embodiment, alumina used as the material for the substrate 37*a* has thermal conductivity of about 26 W/mK, and aluminum used as the material for the heat conduction member 39 has thermal conductivity of about 230 W/mK. In the case where the thermal conductivity of the heat conduction member 39 is larger than the thermal conductivity of the substrate 37*a*, the heat of the heater 37 becomes easy to be uniformized. As the material for the heat conduction member 39, in addition to aluminum, it is also possible to use copper or graphite sheet. As shown in (a) of FIG. 15, the case where a portion H with respect to the direction perpendicular to the recording material feeding direction is higher in temperature than another portion will be described. In addition flow A of heat inside the substrate 37*a* with respect to the direction perpendicular to the recording material feeding direction, flow of heat from the substrate 37*a* toward the heat conduction member 39 is generated at a portion, of the substrate 37*a*, where the substrate 37*a* contacts the heat conduction member 39. Further, this heat flows in the direction perpendicular to the recording material feeding direction in the inside of the heat conduction member 39, and then returns to the substrate 37*a*. By such heat flow, the heat of the heater 37 is uniformized.

Here, a relationship between a width of the heat generating resistor 37*b* of the heater 37 and a width of the heat conduction member 39 with respect to the direction perpendicular to the recording material feeding direction will be described. Parts (a) and (b) of FIG. 18 are enlarged views each showing an end portion in a state in which positions of the heater 37 and the heat conduction member 39 are deviated with respect to the direction perpendicular to the recording material feeding direction. As shown in (a) of FIG. 18, in the case where the end portion of the heat conduction member 39 extends to the outside relative to the end portion of the heat generating resistor 37*b*, in addition to heat flow A and heat flow B, heat dissipation C due to heat dissipation from the end portion of the heat conduction member 39. As a result, at a portion H1 of the heater 37, the temperature is lowered more than necessary, so that improper fixing occurs in some cases at a portion corresponding to the portion H1 when a large-sized recording material is subjected to fixing. Further, as shown in (b) of FIG. 18, in the case where the end portion of the heat generating resistor 37*b* extends to the outside relative to the end portion of the heat conduction member 39, at a portion H2 where the heat flow from the heat generating resistor 37*b* toward the heat conduction member 39 cannot be formed, a suppressing effect of the non-sheet-passing portion temperature rise cannot be obtained.

In view of the above-described circumstances, in this embodiment, with respect to the direction perpendicular to the recording material feeding direction, the width of the heat generating resistor 37*b* and the width of the heat conduction member 39 are made substantially equal to each other. Further, as shown in (b) of FIG. 15, a position of one end portion of the heat generating resistor 37*b* and an associated position of one end portion of the heat conduction member 39 are vertically aligned (as indicated by a broken line X). As a result, the fixing device 36 in this embodiment has an effect such that the non-sheet-passing portion temperature rise during the fixing on the small-sized recording material without generating the improper fixing at the end portion during the fixing on the large-sized recording material.

Next, the reason why the bent portion 39*a* in this embodiment is provided at the end portion of the heat conduction member 39 with respect to the recording material will be described. As Comparison example for this embodiment, as shown in FIG. 16, a constitution in which an L-shaped bent portion 390*b* is provided at each of end portions of a heat conduction member 390 with respect to the direction perpendicular to the recording material feeding direction is shown. This bent portion 390*b* is, as shown in (c) of FIG. 16 as an enlarged view of the bent portion 390*b*, formed by bending the end portion of the heat conduction member 390 in a direction perpendicular to the recording material feeding direction, and a bending length Z is 3 mm. Part (a) of FIG. 16 is a sectional view as seen from a widthwise direction, and (b) of FIG. 16 is a schematic view showing a state in which a supporting member 380 is provided with the heat conduction member 390. As the heat conduction member 390, a 0.3 mm-thick aluminum plate is used, and has the same size as the heat conduction member 39 in Embodiment 3, i.e., has the size of 222 mm in width L with respect to the direction perpendicular to the recording material feeding direction and 5 mm in width M with respect to the recording material feeding direction in the contact region with the heater 37. A difference in constitution of Comparison example from Embodiment 3 is that the heat conduction member 390 includes the L-shaped bent portion 390*b* of 3 mm in length at each of the end portions thereof with respect to the direction perpendicular to the recording material feeding direction and that the bent portions 390*b* are inserted into mounting holes 380*b* provided at end portions of the supporting member 380. Further, each mounting hole 380*b* is formed in a size larger than the associated bent portion 390*b* of the heat conduction member 390 in order to absorb thermal expansion of the heat conduction member 390 with respect to the direction perpendicular to the recording material feeding direction, thus providing play.

Here, a deformation amount ΔL (mm) of the heat conduction member 390 due to the thermal expansion with respect to the direction perpendicular to the recording material feeding direction can be calculated by the following equation:

$$\Delta L = L \times \alpha \times \Delta T,$$

where α represents coefficient of linear expansion, and ΔT represents a difference in temperature.

The heat conduction member 390 is 222 mm in width L, $2.3\times10^{-5}$/° C. in the coefficient α of linear expansion of aluminum, and about 200° C. in temperature of the substrate 37*a* during fixing, and therefore assuming that normal temperature is 20° C., ΔT is 180° C. When the calculation is made by substituting these values into the above equation, ΔL is 0.92 mm. Similarly, a deformation amount ΔM (mm) of the heat conduction member 390 due to the thermal expansion with respect to the recording material feeding direction is 0.02 mm. On the other hand, a liquid crystal polymer ("SUMIKA SUPER LCP E5204L", manufactured by Sumitomo Chemical Company) as a material for the supporting member 380 is $1.3\times10^{-5}$/° C. in coefficient α of linear expansion, and therefore elongates in the direction perpendicular to the recording material feeding direction by 0.52 mm.

In the fixing device in Comparison example, in some cases, the following problem due to a difference in thermal expansion coefficient between the supporting member 380 and the heat conduction member 390 occurs. Parts (a) to (d) of FIG. 17 are sectional views of the supporting member 380 and the heat conduction member 390 as seen from the recording material feeding direction when the fixing device in Comparison example is used. Part (a) of FIG. 17 shows a state in which pressure F of 180 N is applied to the nip. Both of the heat conduction member 390 and the supporting member 380 thermally expand and elongate in the direction perpendicular to the recording material feeding direction, but based on a difference in thermal expansion coefficient, an elongation amount of the heat conduction member 390 is larger than that of the supporting member 380. Part (b) of FIG. 17 shows a state in which the pressure is eliminated by a pressure releasing mechanism. When the pressure in the nip is eliminated, the heat conduction member 390 is liable to move on the supporting member 380. As a result, as shown in (b) of FIG. 17, the heat conduction member 390 moves in an arrow direction (perpendicular to the recording material feeding direction) and is in a state, in some cases, in which the bent portion 390*b* of the heat conduction member 390 contacts the end surface of the hole 380*b*. Next, (c) of FIG. 17 shows a state in which from the state of (b) of FIG. 17, the pressure is applied again to the nip to perform the fixing and thereafter the heat conduction member 390 and the supporting member 380 thermally contract in a cooling process of the fixing device. A contraction amount of the heat conduction member 390 is larger than that of the supporting member 380, and therefore the heat conduction member 390 contracts while deforming its bent portion 390*b*, contacting the end surface of the hole 380*b*, in an open direction. The bent portion 390*b* in Comparison example is formed by bending the end portion of the heat conduction member 390 in the direction perpendicular to the recording material feeding direction, and therefore is liable to open when a force is applied thereto in the direction perpendicular to the recording material feeding direction. When the fixing device is used, this state change from (a) of FIG. 17 to (c) of FIG. 17 is repeated, and therefore as shown in (d) of FIG. 17, the bent portion 390*b* gradually opens. This deformation of the heat conduction member 390 can occur at the end portions of the heat conduction member 390, and therefore the bent portion 390*b* is disconnected from the hole 380*b* of the supporting member 380 in some cases. As a result, the heat conduction member 390 is in a state in which the heat conduction member 390 is not locked to the supporting member 380 with respect to the direction perpendicular to the recording material feeding direction, so that the position of the heat conduction member 390 is deviated relative to the heater 37 in some cases. When the position of the heat conduction member 390 is largely deviated relative to the supporting member 380, a problem such that the above-described improper fixing at the end portion of the large-sized recording material and the non-sheet-passing portion temperature rise cannot be suppressed occurs.

On the other hand, the heat conduction member 39 in Embodiment 3 includes the bent portion 39*a* formed by bending the end portion thereof with respect to the recording material central portion in the direction crossing the direction perpendicular to the recording material feeding direction. The heat conduction member 39 is locked to the supporting member 38 with respect to the direction perpendicular to the recording material feeding direction by inserting the bent portion 39*a* into the hole 38*a* of the supporting member 38. Further, the bent portion 39*a* is provided at a substantially central portion with respect to the direction perpendicular to the recording material feeding direction. The bent portion 39*a* in this embodiment is 8 mm in width a with respect to the direction perpendicular to the recording material feeding direction, and therefore is 0.03 mm in thermal expansion amount with respect to the direction perpendicular to the recording material feeding direction, thus being very small in thermal expansion amount. For that reason, play of the width of the hole 38*a* relative to the bent portion 39*a* can be made small, and therefore positional deviation of the heat conduction member 39 relative to the supporting member 38 can be made small. As a result, the position of the heater 37 with respect to the direction perpendicular to the recording material feeding direction is determined by the supporting member 38, and therefore the positional deviation of the heat conduction member 39 relative to the heater 37 can be made small. As described above, in this embodiment, the width of the hole 38*a* is set at 8.1 mm. Further, the end portions of the heat conduction member 39 with respect to the direction perpendicular to the recording material feeding direction are free, and therefore the bent portion 39*a* is not deformed by thermal expansion and thermal contraction of the heat conduction member 39 itself. Further, a thermal expansion amount ΔM of the heat conduction member 39 with respect to the recording material feeding direction is 0.02 mm, and therefore also with respect to the recording material feeding direction different from Comparison example, the bent portion 39*a* is prevented from opening largely. Further, the bent portion 39*a* is formed by being bent in the direction crossing the direction perpendicular to the recording material feeding direction, and therefore even when the force in the recording material feeding direction is applied to the bent portion 39*a*, the bent portion 39*a* does not deform in the open direction.

As described above, in this embodiment, the state in which the heat conduction member 39 is locked to the supporting member 38 is maintained, and therefore such an effect that the position of the heat conduction member 39 is not readily deviated relative to the heater 37 is achieved. As a result, it is possible to suppress the non-sheet-passing portion temperature rise without lowering the fixing property at the end portions with respect to the direction perpendicular to the recording material feeding direction.

Incidentally, the heat conduction member 39 is locked to the supporting member 38 also with respect to the recording material feeding direction by providing the bent portion 39*a* at an upstream end portion with respect to the recording material feeding direction and then by inserting the bent portion 39*a* into the hole 38*a*.

In this embodiment, the bent portion 39*a* is provided at the end portion of the heat conduction member 39 with respect to the recording material feeding direction, but may also be provided at a central portion of the heat conduction member 39 with respect to the recording material feeding direction. That is, a constitution in which a bent portion formed by bending a part of the heat conduction member itself in the direction crossing the direction perpendicular to the recording material feeding direction is used as a locking portion and the heat conduction member is locked to the supporting member with respect to the direction toner the recording material feeding direction may only be required. However, when the bent portion 39*a* is formed by bending and erecting the central portion of the heat conduction member 39 with respect to the recording material feeding direction, a hole is formed in the heat conduction member 39 to lower a heat conduction performance for uniformizing the heat of the heater 37, and therefore the locking portion may preferably be formed as a separate member.

Embodiment 4

In recent years, in order to shorter the FPOT (first print cut time), shortening of a warm-up time of the fixing device has been required. Therefore, in this embodiment, a constitution in the case where thermal capacity of the heat conduction member is made smaller will be described.

A heat conduction member 391 in this embodiment is made small in thermal capacity by decreasing the width thereof with respect to the recording material feeding direction and the thickness thereof compared with those in Embodiment 3. In this embodiment, as the heat conduction member 391, a 0.2 mm-thick aluminum plate of 3 mm in width with respect to the recording material feeding direction is used. The thermal capacity of the heat conduction member 391 is 40% of the heat conduction member 39 in Embodiment 3, so that the warm-up time can be shortened by 0.1 sec. In this embodiment, a constitution is the same as that in Embodiment 3 except for the heat conduction member 391 and a supporting member 381, and therefore will be omitted from description.

A characteristic constitution of the heat conduction member 391 in this embodiment is that a plurality of locking portions are provided with respect to the direction perpendicular to the recording material feeding direction. As in this embodiment, in the case where the heat conduction member 391, which is thin and small in rigidity, as in this embodiment is used, if the locking portion is provided singly at the central portion as in Embodiment 3, the heat conduction member is deformed in a bow-like shape with respect to the recording material feeding direction as shown in FIG. 19 in some cases. The bow-like deformation of the heat conduction member is generated due to application, to the heat conduction member, of a force directed from an upstream side to a downstream side of the recording material feeding direction via the heater 37 when the film 36 is rotated. The substrate 37*a* is formed of the ceramic material in a thickness of 1.0 mm to provide high rigidity and thus is not readily deformed, whereas the heat conduction member which is the thin aluminum plate is plastically deformed at high temperature in some cases. When the heat conduction member is deformed, the position of the heat conduction member relative to the heat generating resistor 37*b* is deviated, and therefore a problem such that the non-sheet-passing portion temperature rise suppression effect is lowered occurs.

Therefore, in this embodiment, with respect to the direction perpendicular to the recording material feeding direction, the heat conduction member 391 includes a bent portion 391*a* (first locking portion) at a central portion, a bent portion 391*c* (second locking portion) at one end portion and a bent portion 391*d* (third locking portion) at the other end portion. By inserting these bent portions into, as locked portions, holes 381*a*, 381*c* and 381*d*, respectively, so that the heat conduction member 391 is locked to the supporting member 381. The bent portion 391*a* is constituted so as to perform the function as the position with respect to at least the direction perpendicular to the recording material feeding direction, and the bent portions 391*c* and 391*d* are constituted so as to perform the function as the locking portion with respect to at least the recording material feeding direction. Sizes of the bent portion 391*a* and the hole 381*a* were set at a=8 mm, b=3 mm, c=8.1 mm and d=0.3 mm. Sizes of the bent portions 391*c* and 391*d* and the holes

381*c* and 381*d* were set at the same values as those of the bent portion 391*a* and the hole 381*a*. Further, in the contact region of the heat conduction member 391 with the heater 37, the heat conduction member 391 is 222 mm in width L with respect to the direction perpendicular to the recording material feeding direction and 3 mm in width M with respect to the recording material feeding direction.

Incidentally, there is no need to form the bent portions 391*a*, 391*c* and 391*d* in the same size. Further, the bent portions 391*c* and 391*d* may also be provided at end portions with respect to the direction perpendicular to the recording material feeding direction as shown in (a) of FIG. 21, and may also be provided at downstream end portions with respect to the recording material feeding direction as shown in (b) of FIG. 21. In the constitution of (a) of FIG. 21, the function as the position with respect to the direction perpendicular to the recording material feeding direction is performed by the bent portion 391*a*, and the function as the locking portion with respect to the recording material feeding direction is performed by the bent portions 391*c* and 391*d*. Therefore, in the constitution of (a) of FIG. 21, the problem, generated as in Comparison example for Embodiment 3, such that the bent portion at the end portion opens does not occur.

As described above, Embodiment 4 has an effect such that the position of the heat conduction member 391 relative to the heater 37 is not readily deviated while decreasing the thermal capacity of the heat conduction member 391.

Embodiment 5

There is an advantage such that when the press are in the nip is released, engagement (locking) between the heat conduction member and the supporting member is less eliminated with a longer length of the bent portion as the locking portion of the heat conduction member. However, the longer length of the bent portion leads to an increased thermal capacity of the heat conduction member, and in addition, heat is liable to dissipate from the bent portion into the air, and therefore the warm-up time of the fixing device is increased.

Therefore, as the heat conduction member, a member which has a shorter bent portion and which is less disengaged from the supporting member is required.

Therefore, a heat conduction member 392 in this embodiment will be described with reference to FIG. 22. The heat conduction member 392 includes a bent portion 392*a* (first locking portion) at an end portion with respect to the recording material feeding direction, and bent portions 392*c* (second locking portion) and 392*d* (third locking portion) at end portions with respect to the direction perpendicular to the recording material feeding direction. Each of the bent portions 392*c* and 392*d* is provided with a hole 392*e* (engaging portion), and the hole 392*e* is engaged with a claw portion 382*e* (engaging portion) of a supporting member 382. Incidentally, a constitution except for the heat conduction member 392 and the supporting member 382 is the same as that in Embodiment 3, and therefore will be omitted from description.

A further specific constitution of the heat conduction member 392 in this embodiment will be described. The heat conduction member 392 is a 0.2 mm thick aluminum plate of 3 mm in width M with respect to the recording material feeding direction. The heat conduction member 392 includes a bent portion 392*a* at the end portion with respect to the recording material feeding direction similarly as in Embodiment 3 and 4, and the by bent portion 392*a*, the heat conduction member 392 itself is locked to the supporting member 382 with respect to the direction perpendicular to the recording material feeding direction. In Embodiment 5, the heat conduction member 392 further includes the bent portions 392*c* and 392*d*, each having a length b of 2 mm at the end portions with respect to the direction perpendicular to the recording material feeding direction, and each of the bent portions 392*c* and 392*d* is provided with a square through hole 392*e* having a size of 1 mm×1 mm. On the other hand, as shown in (b) of FIG. 22, a constitution in which the supporting member 382 is provided with the claw portion 382*e* at each of the end portions thereof with respect to the direction perpendicular to the recording material feeding direction and the claw portion 382*e* is engaged with the hole 392*e* of the heat conduction member 392 was employed.

In the constitution in this embodiment, in the case where the pressure in the nip is eliminated, even when the length b of each of the bent portions 392*c* and 392*d* is short, the heat conduction member 392 is not readily disengaged from the supporting member 382 in an arrow direction in (b) of FIG. 21. Further, the heat conduction member 392 is engaged with the supporting member 382 at the end portions, and therefore the heat conduction member 392 is not readily deformed in a bow-like shape with respect to the recording material feeding direction.

Incidentally, as described in Embodiment 5, the heat conduction member 392 includes the bent portion 392*a*, and therefore different from Comparison example for Embodiment 3, the bent portions 392*c* and 392*d* are prevented from opening.

As described above, the fixing device in this embodiment has, in addition to an effect that the heat conduction member 392 is not readily deviated relative to the heater 37, an effect that the constitution in this embodiment contributes to shortening of the warm-up time.

Incidentally, in this embodiment, the constitution in which each of the bent portions 392*c* and 392*d* is provided with the hole 392*e* is employed, but the bent portions 392*a* may be provided with the hole 392*e* and then may be engaged with the supporting member 382. In that case, each of the bent portions 392*c* and 392*d* is not necessarily be required to be provided with the hole 392*e* to be engaged with the supporting member 382.

Further, in Embodiments 3 to 5, the locking portion is constituted by the bent portion provided at the end portion of the heat conduction member, but a similar effect is obtained by employing a constitution in which a separate member is mounted, as the locking portion, to the heat conduction member in place of the bent portion.

Further, the problem in Embodiments 3 to 5 described above results from the difference in coefficient of linear expansion between the supporting member and the heat conduction member, and occurs unless those members are formed of the same material. Accordingly, in the case where the heat conduction member and the supporting member are formed of different materials, the effect of the present invention is achieved.

Further, the constitutions of Embodiments 3 to 5 are not limited to those for the fixing device but may also be applicable to an image heating apparatus (device) for heating a toner image.

While the invention has been described with reference to the structures disclosed herein, it is not confined to the details set forth and this application is intended to cover such modifications or changes as may come within the purpose of the improvements or the scope of the following claims.

This application is a Divisional Application of U.S. patent application Ser. No. 14/955,334, filed on Dec. 1, 2015, which is a Divisional Application of U.S. patent application Ser. No. 14/141,687, filed on Dec. 27, 2013, and issued as U.S. Pat. No. 9,229,388, on Jan. 5, 2016. These U.S. patent applications claim the benefit of priority from Japanese Patent Application Nos. 2012-288234, filed Dec. 28, 2012, and 2013-122215, filed Jun. 10, 2013. Each of these documents is incorporated by reference in its entirety.

What is claimed is:

1. A fixing device for fixing a toner image on a recording material, the fixing device comprising:

a rotatable heating member;

an elongated heater having a first surface and a second surface opposite to the first surface, the first surface of the heater contacting the rotatable heating member;

a heat conduction member configured to contact the second surface of the heater, the heat conduction member extending in a longitudinal direction of the heater; and a supporting member configured to support the heater through the heat conduction member, wherein the heat conduction member includes a first engaging portion and a second engaging portion provided at a position different from that of the first engaging portion in a longitudinal direction of the heat conduction member, and the supporting member includes a first engaged portion engaged with the first engaging portion, and a second engaged portion engaged with the second engaging portion, and wherein the first engaging portion of the heat conduction member includes a first contact surface that contacts the first engaged portion of the supporting member so as to determine a position of the heat conduction member, with respect to the supporting member, in the longitudinal direction of the heat conduction member, and the second engaging portion of the heat conduction member includes a second contact surface that contacts the second engaged portion of the supporting member so as to determine a position of the heat conduction member, with respect to the supporting member, in a widthwise direction of the heat conduction member perpendicular to both the longitudinal direction of the heat conduction member and a direction from the first surface of the heater to the second surface of the heater, a normal direction of the first contact surface of the first engaging portion crossing a normal direction of the second contact surface of the second engaging portion.

2. The fixing device according to claim 1, wherein the heat conduction member is a plate-like member, and the first contact surface and the second contact surface are provided on a plate thickness cross section of the heat conduction member.

3. The fixing device according to claim 1, wherein the rotatable heating member is a cylindrical film.

4. The fixing device according to claim 3, further comprising a roller, wherein the first surface of the heater contacts an inner surface of the film and forms a nip, at which the recording material on which the toner image is formed is fed, with the roller via the film.

5. The fixing device according to claim 1, wherein the heat conduction member is a metal plate.

6. The fixing device according to claim 1, wherein the heat conduction member is a plate-like member, wherein the first engaging portion of the heat conduction member is a first bent portion formed by bending a part of the heat conduction member so that the first bent portion protrudes toward the supporting member and a ridge line of the first bent portion extends along the longitudinal direction of the heat conduction member, and the second engaging portion of the heat conduction member is a second bent portion formed by bending a part of the heat conduction member so that the second bent portion protrudes toward the supporting member and a ridge line of the second bent portion extends along the widthwise direction of the heat conduction member, and wherein the first contact surface of the first engaging portion is a surface of the first bent portion that is perpendicular to the ridge line of the first bent portion, and the second contact surface of the second engaging portion is a surface of the second bent portion that is perpendicular to the ridge line of the second bent portion.

7. The fixing device according to claim 1, wherein the normal direction of the first contact surface of the first engaging portion is orthogonal to the normal direction of the second contact surface of the second engaging portion.

8. The fixing device according to claim 1, wherein the first engaging portion is arranged at a position nearer a longitudinal center of the heat conduction member than the second engaging portion, in the longitudinal direction of the heat conduction member.

* * * * *